US005657606A

United States Patent [19]

Ressel et al.

[11] Patent Number: 5,657,606

[45] Date of Patent: *Aug. 19, 1997

[54] BUILDING SYSTEM

[76] Inventors: Dennis Edward Ressel, 8275 Mondavi Pl., Rancho Cucamonga, Calif. 91730; Valente Covarrubias Nuno, 5593 Denver St., Montclair, Calif. 91763

[ * ] Notice: The terminal 13 months of this patent has been disclaimed.

[21] Appl. No.: 149,477

[22] Filed: Nov. 9, 1993

[51] Int. Cl.[6] ..... E04C 3/02

[52] U.S. Cl. ..... 52/690; 52/695; 52/481.1; 52/648.1; 52/293.1; 52/586.1

[58] Field of Search ..... 52/690, 695, 639, 52/643, 481.1, 289, 93.2, 648.1, 293.1, 586.1

[56] References Cited

U.S. PATENT DOCUMENTS

| | | | |
|---|---|---|---|
| 1,748,794 | 2/1930 | Ray | 52/289 X |
| 1,818,418 | 8/1931 | Millard | 52/289 |
| 1,858,701 | 5/1932 | Boettcher | 52/289 X |
| 3,611,664 | 10/1971 | Barbera | 52/481.1 |
| 3,998,016 | 12/1976 | Ting | 52/481.1 X |
| 4,235,054 | 11/1980 | Cable et al. | 52/481.1 X |
| 4,455,792 | 6/1984 | Pasco | 52/93.2 |
| 4,559,748 | 12/1985 | Ressel | 52/93.2 |
| 4,817,356 | 4/1989 | Scott | 52/690 X |
| 4,890,437 | 1/1990 | Quaile | 52/690 |

*Primary Examiner*—Wynn E. Wood

[57] ABSTRACT

Partially fabricated building systems include pre-fabricated wall panel subassemblies formed of steel tubing. A subassembly includes a rigid frame defining a shallow rectanguloid volume with an outer face and an inner face. The frame includes at least one horizontal dividing member, a plurality of vertical support members, some located above and others below the horizontal dividing member(s), with a surface of the vertical support members oriented flush with an outside face of the frame, a plurality of strut members oriented at an angle to the vertical and horizontal extend between at least one portion of said frame across at least some of the vertical support members and are rigidly connected thereto with an outer surface of said strut members being oriented flush with the inner face of the frame. A number of steel post oriented in a vertical, spaced apart relationship, are rigidly connected to the inner face of the frame. Each of the posts has a foot portion for contacting a foundation external of said subassembly and has a top portion with a saddle connection members rigidly connected thereto to serve as support for another building frame subassembly external of said subassembly overlying the posts. With one subassembly located in an overlying relationship with another subassembly and the posts carried by each are in vertical alignment.

21 Claims, 13 Drawing Sheets

BUILDING SYSTEM

FIELD OF THE INVENTION

This invention relates to improved, partially prefabricated building systems and, more particularly, to improved frame subassemblies for a steel frame building structure.

BACKGROUND OF THE INVENTION

In recent years conventional wood frame building material has increased in expense while the quality of that wood has fallen and forest supplies dwindle. Such is the consequence of over consumption and environmental regulations, as well as restrictions on logging intended to protect the forests. Those factors give incentive to the use of alternative building materials, such as steel. In reducing demand for wood, steel thus may be regarded as being environmentally friendly.

Readily erectable economic building systems and elements thereof of a wide variety, which use steel as the frame material, have been known to the prior art, including those building systems described in U.S. Pat. No. 4,599,748, entitled Pre-Formed Building Systems, granted Dec. 24, 1985, to Dennis E. Ressel, the present inventor, hereafter sometimes referred to as the Ressel Patent. As taught in the Ressel Patent, steel frame panel subassemblies may be preformed in the factory and moved to the building site where the building frame is assembled. Buildings of various sizes can be assembled from combinations of several standard size panel assemblies on site on a prepared concrete foundation, easily and economically, usually by relatively unskilled labor. Those persons bolt together the various panels to complete the buildings skeletal frame and then follow with the siding and other detail work to complete the building. Building structures constructed in accordance with the teachings of the Ressel Patent are found effective and extremely strong.

A structural feature of the prior Ressel building system is the inclusion of square sheets of material, wood sheathing, in the panel subassemblies. The sheathing is mounted at the job site to the vertical members of the wall panel subassemblies using sheet metal screw type fasteners. Such sheathing enhanced the rigidity of the associated panel subassembly, particularly, preventing distortion of the subassembly's rectangular shape by shear forces applied to the panel subassembly while the bottom of the subassembly is firmly anchored to the concrete foundation. As those skilled in the art appreciate any shear force, as could be caused by high winds hitting a building structure, tends to stress the rectangular shape of an anchored rectangular frame to that of a rhombus or parallelogram. If the rectangular shape is not sufficiently rigid, the shear force could cause failure of the rectangular frame. The sheathing also provides some slight advantage in insulating the structure. Although that additional strength is desired in many instances, the sheathing is not free of cost.

The additional on site work required to assemble the sheathing and the added material that the manufacturer is required to procure and truck to the building site is viewed as a cost disadvantage. The present invention improves upon the prior wall panel assembly by eliminating the need for such sheathing, while retaining adequate shear resistance, a decided advantage. The present invention improves upon the subassembly structure illustrated in the Ressel Patent in one respect by integrating therein additional bracing structure to adequately resist shear force in the absence of the sheathing. Fabricated entirely in the factory, the improved wall panel subassembly provides substantial overall savings in weight, material costs, shipping costs, and on site labor costs.

A second characteristic of the building systems described in the Ressel Patent is the inclusion of the double vertical support column. That is, separate posts formed from steel tubing were welded together and anchored into place on the foundation to create additional support to the buildings' subassemblies. Primarily, the wall panel subassemblies are assembed and anchored to the foundation, thereafter, the posts are connected to and aligned with the vertical members of those wall panel subassemblies wherein the double vertical support column are aligned with the juncture of two panel subassemblies. The foregoing system thus requires separate assembly steps. It also uses more expensive materials, since the tubing material is more expensive, as example, than a U-shaped channel member. An added advantage to the present invention is that such additional support columns are essentially eliminated as an independent element. The function of that post is instead integrated into the wall panel subassembly, suitably as channel members. By bolting a panel subassembly to the foundation, the post are automatically positioned on the foundation and need not be separately bolted thereto. The invention, thereby eliminates a required on site building step, a decided cost advantage.

Accordingly, an object of the present invention is to provide and improved factory assembled rigid wall frame subassembly that may be produced at lower cost and that allows a building structure to be assembled more easily and quickly than heretofore.

Another object of the invention is to provide an improved building structure, in particular a multi-story building structure, of the partially factory preassembled type that incorporates the novel wall frame subassembly.

A still additional object is to provide a building structure that minimizes and/or avoids the use of separate individually mounted support columns and to provide a panel assembly which integrates the function served by those support columns whereby the building frame structure can be assembled more quickly and easily heretofore.

While the present invention improves upon the building system described in the Ressel Patent, the invention features elements and techniques in common therewith. The Ressel Patent contains description of assembly techniques and illustration of building systems that are useful as: background; an aid to understanding and description of the present invention. Accordingly, the text and illustrations of the Ressel Patent, U.S. Pat. No. 4,559,748, are referred to and incorporated herein in its entirety and forms part of the disclosure of this specification.

SUMMARY OF THE INVENTION

Preassembled self supporting rigid frame panel subassemblies, according to the invention, are characterized by a rectangular frame or a rectangular fame section in which four straight steel tubing members, rectangular or square in cross section, are rigidly connected together, suitably by welds, to define a shallow rectanguloid shaped volume of a predetermined area and of predetermined depth. At least one horizontal dividing member is included in that defined volume rigidly connected between vertical members. A plurality of vertical support members are included in that defined volume and rigidly connected to and between at least one of said upper and lower horizontal end members and a horizontal dividing member in vertical orientation. Such vertical support members being of a cross section shape smaller than that of the framing members with a surface of those support members being oriented essentially flush with a first side or outside of the defined volume.

At least one strut member has a first end connected within said rectangular volume to a framing member at one formed corner of the frame and its other end connected within said predetermined rectangular volume to another of the framing members. Such strut member extends diagonally, within and across, the face of the rectangular volume at a predetermined angle relative to both the vertical and the horizontal and with a surface that strut member being oriented essentially flush with a second side or inside of the defined volume. The strut extends across each vertical support member and is rigidly connected, suitably by welds, to each of said vertical support members so traversed.

In an additional aspect of the invention at least one elongate support column or post is included, located outside and on the second or inner side of the defined volume, with the post being carried by the frame. Suitably, the post is formed of a U-shaped channel member.

A multi-story building structure is assembled with such panel subassemblies on both the upper and lower stories. Panel subassemblies constructed according to the invention may be incorporated within a multi-floor building structure and provide support for the second floor assemblies or roof truss assemblies. In accordance with an additional aspect of the invention, an upper floor wall panel subassembly, carrying at least one post, is mounted atop a lower floor subassembly also carrying at least one post, with the posts on one being in vertical alignment with the other. The clearance spacing between the foot end of the upper floor post and the top end of the lower floor post accommodates and end of a rectangular shaped floor truss member, orthogonal thereto, and flooring material overlying that floor truss member, whereby the foot end of the second floor post contacts the flooring material. Any vertical downward directed compressive force on the upper floor post and the associated upper floor panel subassembly is thereby transmitted through the flooring, the floor truss, the underlying lower floor post and its associated lower floor panel subassembly to the building foundation.

The foregoing, along with additional objects and advantages of the invention, together with the structure characteristic thereof, which were only briefly summarized in the preceding passages, becomes more apparent to those skilled in the art upon reading the detailed description of a preferred embodiment, including the appended claims, presented in the accompanying drawings.

BRIEF DESCRIPTION OF THE DRAWINGS

In the drawings:

FIG. 4 is an elevational view of a first floor side wall half panel subassembly, drawn at the same scale as FIGS. 1 and 2, that employs the same construction techniques used in the subassemblies of FIGS. 1 and 2;

DETAILED DESCRIPTION OF THE PREFERRED EMBODIMENTS

Figure 1:
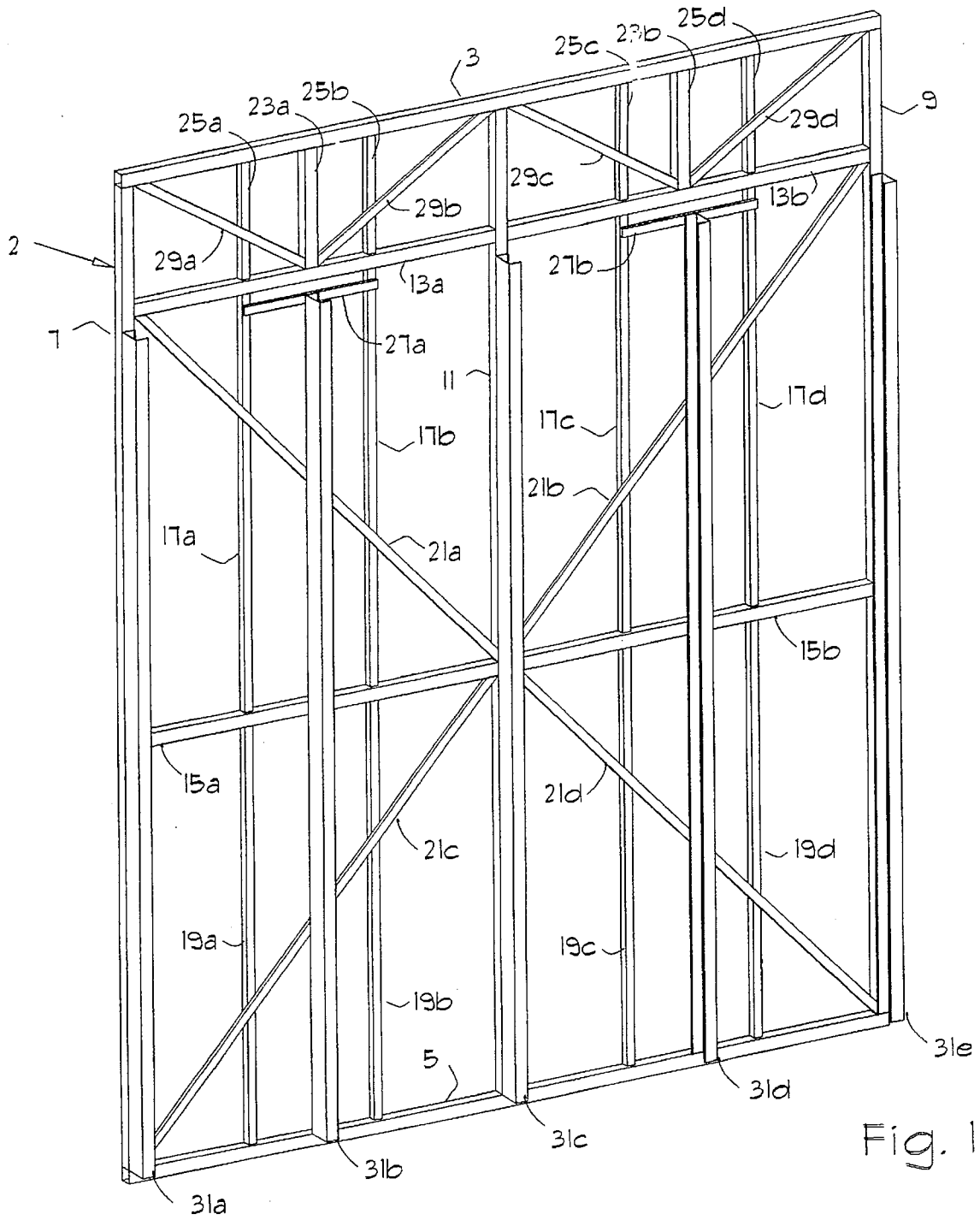
FIG. 1 illustrates a side wall panel subassembly for the first floor of a multi-story building structure in perspective view.

Reference is made to FIG. 1 which illustrates in isometric view a side wall panel subassembly 2, showing a rigid rectangular frame formed of steel tubing members of, essentially, a square cross section. An upper frame member, 3, at the top and a lower frame member, 5, at the bottom are each welded on its under side and upper side surfaces, respectively, at a right angle to the upright or vertical frame member, 7, on the left side, and to the upright or vertical frame member, 9, on the right side. A vertical dividing member, 11, located midway between and parallel to the left side, 7, and right side, 9, vertical frame members, is also welded in place between upper frame member 3, and lower frame member 5. A pair of horizontal dividing members 13*a* and 13*b*, are welded between vertical frame member 7 and vertical dividing member 11 and between vertical dividing member 11 and vertical frame member 9. The horizontal members in the pair are aligned horizontally and are formed of the same tubular material as the frame members. Such horizontal dividing members are also located a short distance below upper frame member 3 to form a floor truss riser region. Since this subassembly is intended to assist in the support of a second story to the building, the narrow rectangular region between upper frame member 3 and horizontal dividing members 13*a* and 13*b* provides for the connection of a floor support truss as later discussed.

Steel tubing used as frame material is not typically cylindrical in shape, but is rectangular in cross section. One is reminded that a rectangle is a parallelogram, a four sided figure, in which all angles connecting the sides are at right angles, ninety degrees. Where those sides are equal in length, the figure is referred to as a square.

Another pair of horizontal dividing members, 15*a* and 15*b*, are welded into place between the same three vertical members, 7, 9 and 11 with the members in the pair being aligned horizontally. The second pair of members as shown bisect the essentially square area formed by the first pair of horizontal dividing members, 13*a* and 13*b*, lower frame member 5, and vertical frame members 7 and 9 within the larger rectangular frame. The horizontal dividing members are suitably of the same tubular material as the frame members 3, 5, 7, and 9 and, hence, are the same cross section in shape.

A series of vertical support members 17*a*, 17*b*, 17*c*, and 17*d* are welded in place with member 17*a* and 17*b*, horizontally spaced evenly between vertical frame member 7 and vertical dividing member 11 and welded between horizontal dividing members 13*a* and 15*a* with vertical support members 17*c* and 17*d* being horizontally spaced evenly between vertical frame member 9 and vertical dividing member 11 and welded between horizontal dividing members 13*b* and 15*b*. A like series of vertical support members 19*a*, 19*b*, 19*c*, and 19*d* are located below horizontal dividing members 15*a* and 15*b* with 19*a* and 19*b*, being spaced evenly between vertical frame member 7 and vertical dividing member 11 and welded between horizontal dividing member 15*a* and lower frame member 5, and vertical support members 19*c* and 19*d* being spaced evenly between vertical frame member 9 and vertical dividing member 11, and welded between horizontal dividing member 15*b* and lower frame member 5. As shown the vertical support members of the second series are aligned with the corresponding vertical support members of the first series.

Four diagonal braces or struts 21*a*, 21*b*, 21*c*, and 21*d* are connected to the frame and extend diagonally to a central location within the frame at the juncture of vertical dividing member 11 and horizontal dividing members 15*a* and 15*b*. Specifically, strut 21*a* is welded at one end to the underside of horizontal dividing member 13*a* at the juncture of vertical frame member 7 and horizontal dividing member 13*a*; at its other end it is welded to the left side of vertical dividing member 11 at the juncture of vertical dividing member 11 and horizontal dividing member 15*a*; strut 21*b* is welded at one end to the underside of horizontal dividing member 13*b* at the juncture of vertical frame member 9 and horizontal dividing member 13*b*; at its other end it is welded to the right side of vertical dividing member 11 at the juncture of vertical dividing member 11 and horizontal dividing member 15*b*; strut 21*c* is welded at one end to the left side of vertical frame member 7 at the juncture of vertical frame member 7 and lower end member 5; at its other end it is welded to the underside of horizontal dividing member 15*a* at the juncture of vertical dividing member 11 and horizontal dividing member 15*a*; strut 21*d* is welded at one end to the left side of vertical frame member 9 at the juncture of vertical frame member 9 and lower end member 5; at its other end it is welded to the underside of horizontal dividing member 15*b* at the juncture of vertical dividing member 11 and horizontal dividing member 15*b;*

A pair of short vertical risers 23*a* and 23*b* are respectively located equidistant between members 7 and 11 and members 11 and 9 and are welded between upper end member 3 and horizontal members 13*a* and 13*b*, respectively. A first pair of short vertical support members 25*a* and 25*b* are oriented in vertical alignment with their corresponding vertical support member 17*a* and 17*b*, respectively, at each side of riser 23*a* and welded into place as such. A like pair of short vertical support members 25*c* and 25*d* are oriented in vertical alignment with their corresponding vertical support member 17*c* and 17*d*, respectively, at each side of riser 23*b* and welded into place as such.

The upper section of the subassembly is further braced by struts 29*a*, 29*b*, 29*c*, and 29*d*. Each of the struts extends from an upper corner area to a diagonally opposite lower corner at the associated vertical riser 23. Specifically, strut 29*a* is welded to the under side of upper end member 3 at the juncture of vertical frame member 7 and upper end member 3; at the other end, strut 29*a* is welded to the left side of vertical riser 23*a*at the juncture of riser 23*a* and horizontal dividing member 13*a*. Strut 29*b* is welded to the under side of upper end member 3 at the juncture of vertical dividing member 11 and upper end member 3; at the other end, strut 29*b* is welded to the right side of vertical riser 23*a* at the juncture of riser 23*a* and horizontal dividing member 13*a*. Strut 29*c* is welded to the under side of upper end member 3 at the juncture of vertical dividing member 11 and upper end member 3; at the other end, strut 29*c* is welded to the left side of vertical riser 23*b* at the juncture of riser 23*b* and horizontal dividing member 13*b*. Strut 29*d* is welded to the under side of upper end member 3 at the juncture of vertical frame member 9 and upper end member 3; at the other end, strut 29*d* is welded to the right side of vertical riser 23*b* at the juncture of riser 23*b* and horizontal dividing member 13*b*.

Each of the struts are also welded to the vertical support members across which it traverses. Thus, strut 21*a* is welded to vertical support members 17*a* and 17*b*. The remaining struts are likewise welded into place. As one appreciates, the result is a rigid assembly that is strong and capable of supporting a large weight and which should not distort as a result of shear force with the subassembly bolted into place along its bottom frame member to the prepared concrete foundation, for example, such as a force applied to the top of vertical frame member 9 pushing toward the bottom of vertical frame member 7.

The frame members define a somewhat shallow rectanguloid volume, much like the sides of a sand box, with a rectangular front and back face and of short depth equal to the thickness of the frame members. For convenience, the most distant side of that defined volume in the figure which corresponds to the outside surface of the panel subassembly, is referred to as the front face. That side of the volume in the figure closest to the reader is referred to as the back face or inside surface of the panel subassembly. Each of the vertical support members 17, 19, 25 and strut members 21 and 29 lie within that defined volume. One may make brief reference to FIG. 3 which shows the subassembly in plan view and better illustrates the shallow rectanguloid shape.

The vertical support members are formed of steel tubing and are of a square cross section, but that cross section is smaller in area than the cross section of than of frame members 7 and 9, upper and lower members 3 and 5, vertical dividing member 11, vertical risers 23*a* and 23*b*, and horizontal dividing members 15*a*, 15*b*, 13*a* and 13*b*. When welded in place, a flat surface of the vertical support members is flush with the front face of the subassembly, leaving a slight clearance between the opposed flat surface of that vertical support member and the edge of horizontal dividing members 13*a* and 15*a* and the frame member 5 on the inside surface of the subassembly. That clearance is sufficient to receive the cross section of the diagonal struts 21*a*, 21*b*, 21*c* and 21*d*, which are smaller still in cross section than the vertical support members. The respective struts thus cross over the vertical dividing members with one surface of the strut in contact with that vertical member and welded to it, while the opposed or outer surface of such struts are flush with the back face of the subassembly.

In this panel subassembly, five U-shaped channel members 31*a*, 31*b*, 31*c*, 31*d* and 31*e*, which serve as posts in application, are carried by the frame and are rigidly connected to that frame, suitably by welds. In assembling a structure with a second floor, floor trusses, hereafter described, are oriented orthogonal to the subassembly and are bolted at end frame members to the vertical dividing member, vertical frame members and vertical risers. The bottom of the truss may abut the top of the posts, which thus serve as supplementary support to that provided by the subassembly frame. To accommodate channel members 31*b* and 31*d*, two rectangular tubular steel mounting brackets 27*a* and 27*b*, respectively, are located just below horizontal dividing members 13*a* and 13*b*, respectively, and are rigidly connected between vertical support members 17*a* and 17*b* and between vertical support members 17*c* and 17*d*, respectively, and are oriented horizontal.

Channel members 31*b* and 31*d* are of a length sufficient to extend between the respective support brackets 27*a* and 27*b* and the upper edge bottom frame member 5, leaving the bottom end of the channel recessed form the bottom of the frame subassembly, This creates, leaving the bottom end of the channel recessed form the bottom of the frame subassembly, This creates a step at the bottom end of the panel subassembly, the significance of which is later discussed. The remaing channel members are of the same length as the aforementioned channel members.

Channel members 31*b* and 31*d* are of a length sufficient to extend between the respective support brackets 27*a* and 27*b* and the upper edge of lower frame member 5 leaving the bottom end of the channel recessed from the bottom of the panel subassembly. This creates a step at the bottom end of the frame, the significance of which is later discussed. The remaining channel members are of the same length as the aforementioned channel members and are horizontally aligned. It may be noted that the U-shaped channel members are preferred since they are lower in cost than rectangular cross section tubular steel members and are sufficient to accomplish the task. Additionally, the throat of the channel assists in holding thermal insulation in place, should it be desired to insulate the building. However, steel tubes of rectangular or square cross section may be substituted if desired or required.

Channel members 31*a* and 31*e* are aligned with and overlie left and right vertical frame members 7 and 9, respectively. Channel member 31*c* is aligned with and overlies vertical dividing member 11. Channel member 31*b* is welded to support bracket 27*a*, horizontal member 15*b*, struts 21*a* and 21*c*, and the lower frame member 5 and is located in horizontal alignment with riser 23*a*. The channel member is located midway between vertical members 7 and 11. Likewise channel member 31*d* is located midway between vertical members 9 and 11, in line with vertical riser 23*b* and is welded to support bracket 27*b*, horizontal member 15*b*, struts 21*b* and 21*d*, and lower frame member 5.

The elongate opening or throat of channel members 31*a* and 31*e* face in toward channel member 31*c*, while the orientation of the openings of the remaining channel members, 31*b*, 31*c*, and 31*d* are arbitrary. Those opening allow the channel members to at least partially hold thermal insulating material, should it be desired to insulate the walls of the building. It is also recognized that the channel members may be made greater in depth than illustrated in FIG. 1, so as to accommodate a thicker wall section and more thermal insulation material. It is further recognized that the channel members may be made greater in length than illustrated in FIG. 1, in which case support brackets 27*a* and 27*b* may be omitted. Instead the top edge of the channel member would be rigidly connected to the bottom edge of horizontal dividing members 13*a* and 13*b*, respectively. Channel members 31*a* and 31*e* are oriented so as to allow the flat side of the channel to abut an adjacent channel member of and adjacent panel subassembly.

In select assemblies at corners in the building system wherein vertical side members of orthogonal panel subassemblies are placed in a corner, the associated channel members are spaced a short distance from the vertical side member and do not overlie those frame members as later discussed in connection with FIG. 6.

Suitable bolt holes are formed in the bottom frame member to anchor the panel subassembly to the concrete foundation. Bolt holes are also formed in the vertical risers and the upper end of the vertical dividing member and frame members to provide for the connection of the second floor trusses. Additional bolt holes are formed in the vertical frame member extending transversely of the subassembly to permit the subassembly to be bolted to adjacent panel subassemblies during the construction of the building structure.

It is recognized that the steel tubing elements may be varied in size and thickness in accordance with the present invention. However, by way of example only, the frame members may be formed of 1½" square eighteen gauge steel, the vertical support members may be formed of 1" square eighteen gauge steel, the struts may be formed of ½" by 1" eighteen gauge steel. The channel members may be formed of 1⅜" by 3¼" eighteen gauge steel.

Figure 2:
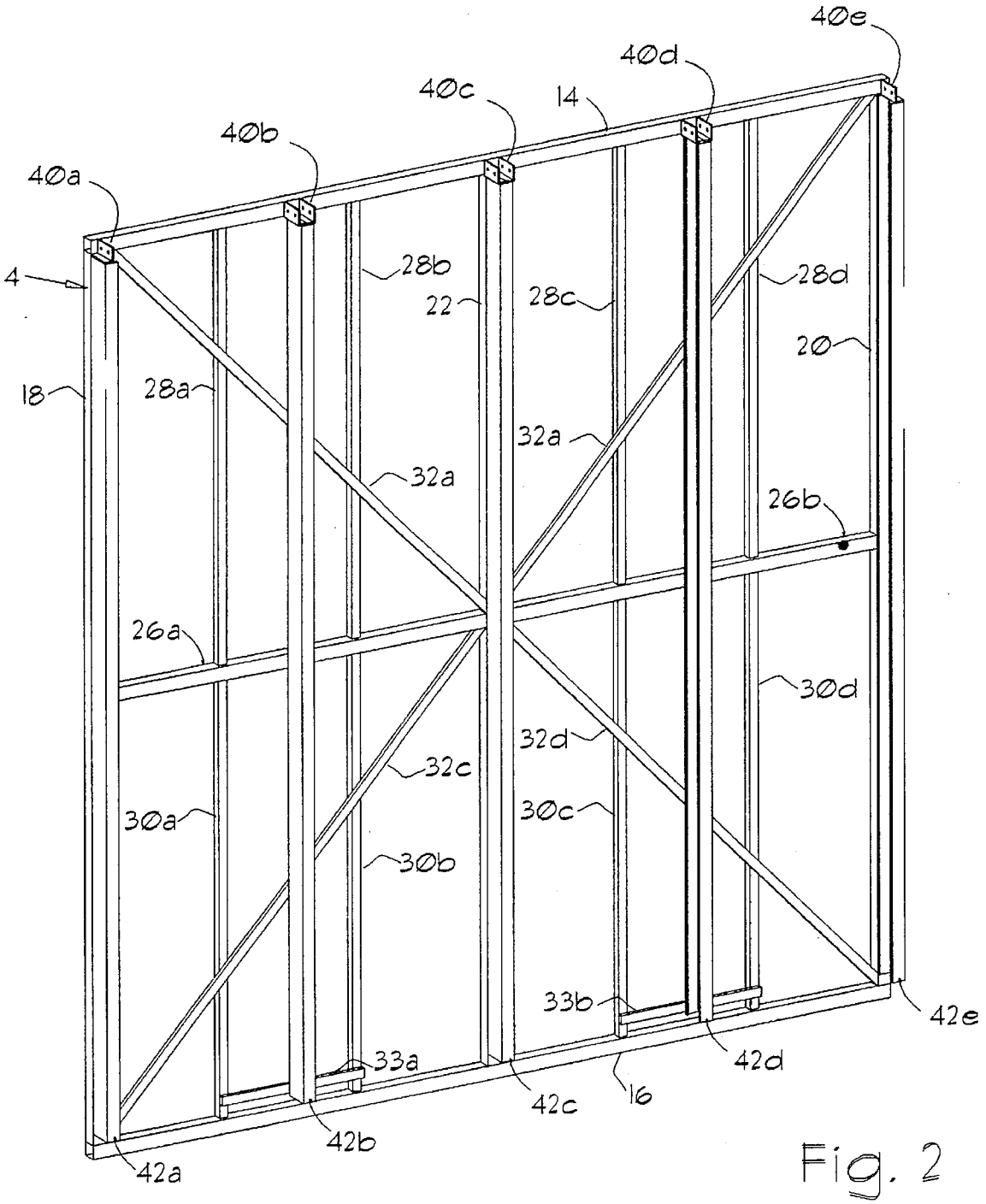
FIG. 2 illustrates a side wall panel subassembly for the top floor wall of a multi-story building structure in isometric view that is the same width as the subassembly of FIG. 1 and is to be mounted atop that subassembly.

The wall panel subassembly 4 illustrated in FIG. 2 incorporates the same principal elements heretofore considered in the subassembly of FIG. 1 and serves either as a top floor wall in a multi-story building structure that incorporates the subassembly of FIG. 1 as the wall panel subassembly for the first floor; or as the first floor wall subassembly for a single story structure. The subassembly contains the upper horizontal frame member 14, the lower horizontal frame member 16, right and left vertical frame members, 18 and 20, welded together and defining the rectangular frame, vertical dividing member 22, horizontal dividing members 26*a* and 26*b*, the first series of vertical support members 28*a*, 28*b*, 28*c* and 28*d*, and the second series 30*a* through 30*d*, and the strut members 32*a* through 32*d*. Also, five channel members 42*a*, 42*b*, 42*c*, 42*d*, and 42*e*, which serve as posts or support columns are included. To accommodate channel members 42*b* and 42*d*, two horizontal rectangular mounting braces are welded between vertical support members 30*a* and 30*b*, and 30*c* and 30*d*, respectively, a short distance above lower horizontal frame member 16.

The channel members are positioned on the frame so that they are raised above the frame bottom by a distance that allows insertion not only of the floor truss member, but also insertion of the actual flooring material, such as a sheet of wood or metal floor decking to receive light weight concrete or the like. This permits the bottom of the channel member to abut the finished floor. It is recognized that in other embodiments the length of the channel member may be greater so that its bottom extends to the top surface of the lower horizontal frame member 16, in which the channels bottom end would abut the top of the floor truss.

The foregoing panel subassembly is formed of steel tubing of the same square cross section as in the preceding figure, which, for one, minimizes the variety of steel materials that the manufacturer is required to procure and inventory. The foregoing are rigidly connected with welds in the same manner and relationship as the subassembly of FIG. 1 with the exception that the upper end of the first series of vertical support members, the vertical dividing member and the diagonal struts are welded to the upper frame member 14, instead of the horizontal dividing members necessitated by the riser section in the prior subassembly. An additional difference is that the channel members in this panel subassembly includes two types of saddle connectors 40*a* through 40*e*, each of which is connected to the upper member 14 and a respective channel member 42*a* through 42*e* suitably by welds. Each saddle member contains bolt openings intended to permit an end of the roof truss, which when assembled extend orthogonal to the subassembly, to be bolted to the panel subassembly. One type of saddle member is located on the right most channel member, 42*a*, and left most channel member, 42*e*, and a second type is connected to the intermediate ones, 42*b* through 42*d*, as later herein described. The saddle member extends slightly above the end of the respective channel member to the top edge of the frame.

Figure 3:
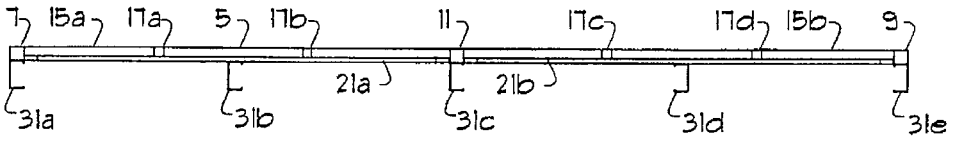
FIG. 3 illustrates in plan view of the subassemblies depicted in FIGS. 1 and 2 taken along the line 1—1.

FIG. 3 illustrates in an equal scale a section of FIG. 1 taken along the line 1—1 in FIG. 1. As shown vertical frame members vertical frame members 7 and 9 define the width of the shallow rectanguloid volume. Vertical support members 17*a* through 17*d* have their outer surface flush with, that is lying in the same plan as the outer surface of the rectanguloid volume defined by the straight line representing the horizontal dividing members 15*a* and 15*b*, and lower frame member 5 below. The struts, such as strut 21*a*, has its outer surface flush with the inner face of the rectanguloid volume and its opposed face in contact with the vertical support members. The appended channel members 31*a* through 31*e* are seen to protrude orthogonal from the inner surface of the rectanguloid volume.

Figure 4A:
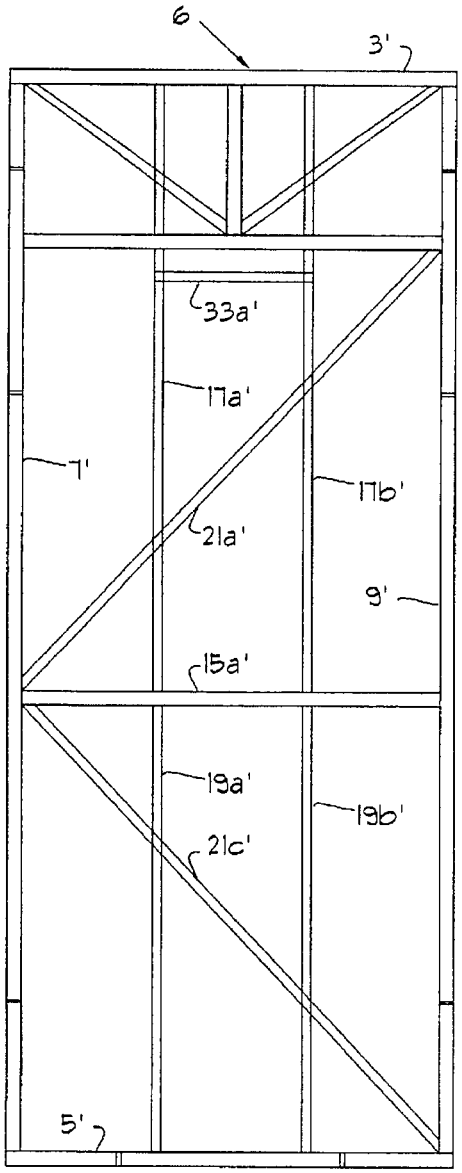
FIG. 4A is a perspective view of the half panel depicted in FIG. 4.
Figure 5A:
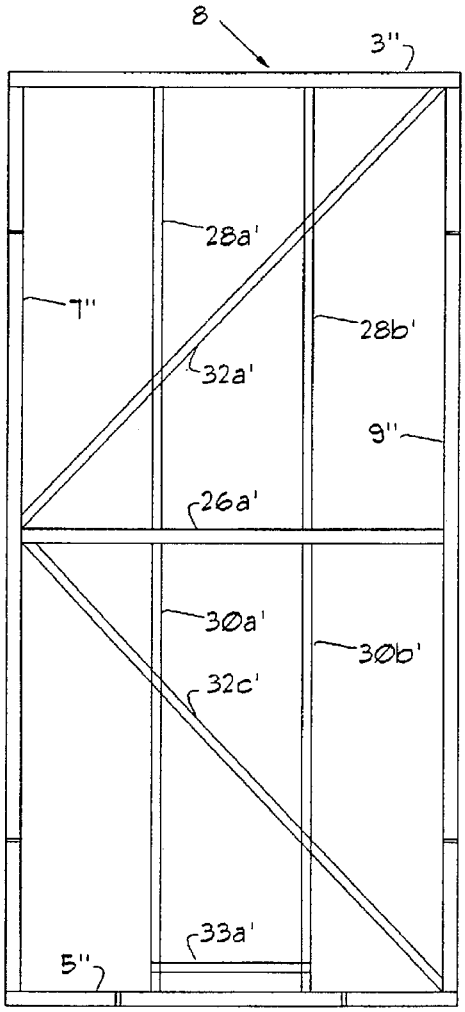
FIG. 5A illustrates a top floor wall half panel subassembly drawn at the same scale as FIG. 4 and employs the same construction techniques used in the subassemblies of FIGS. 1 and 2.
Figure 5B:
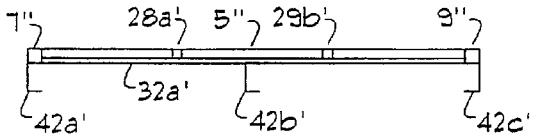
FIG. 5B illustrates in plan view of the subassemblies depicted in FIGS. 4 and 5B taken along line 5—5.
Figure 4A:
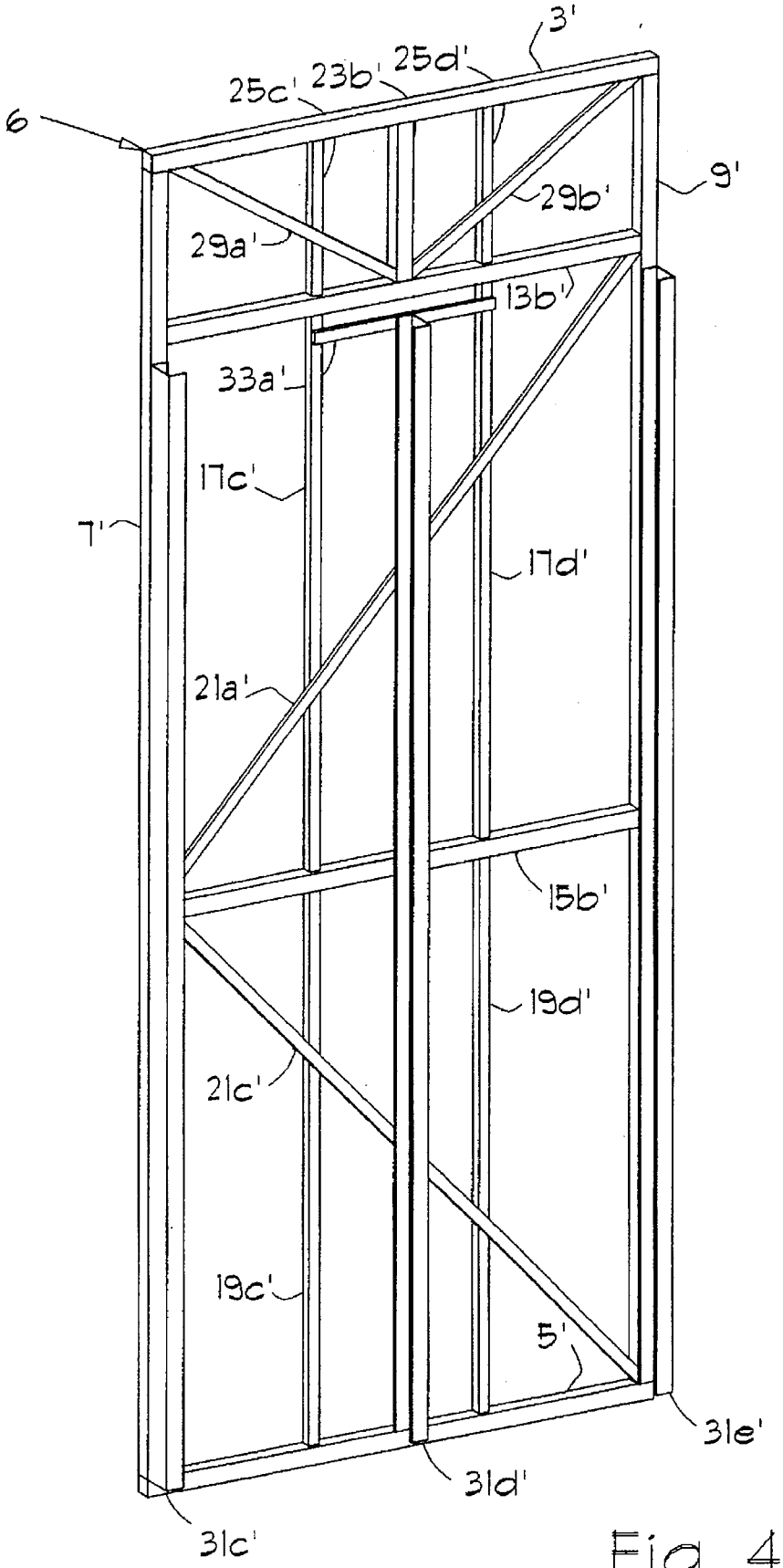
Figure 5C:
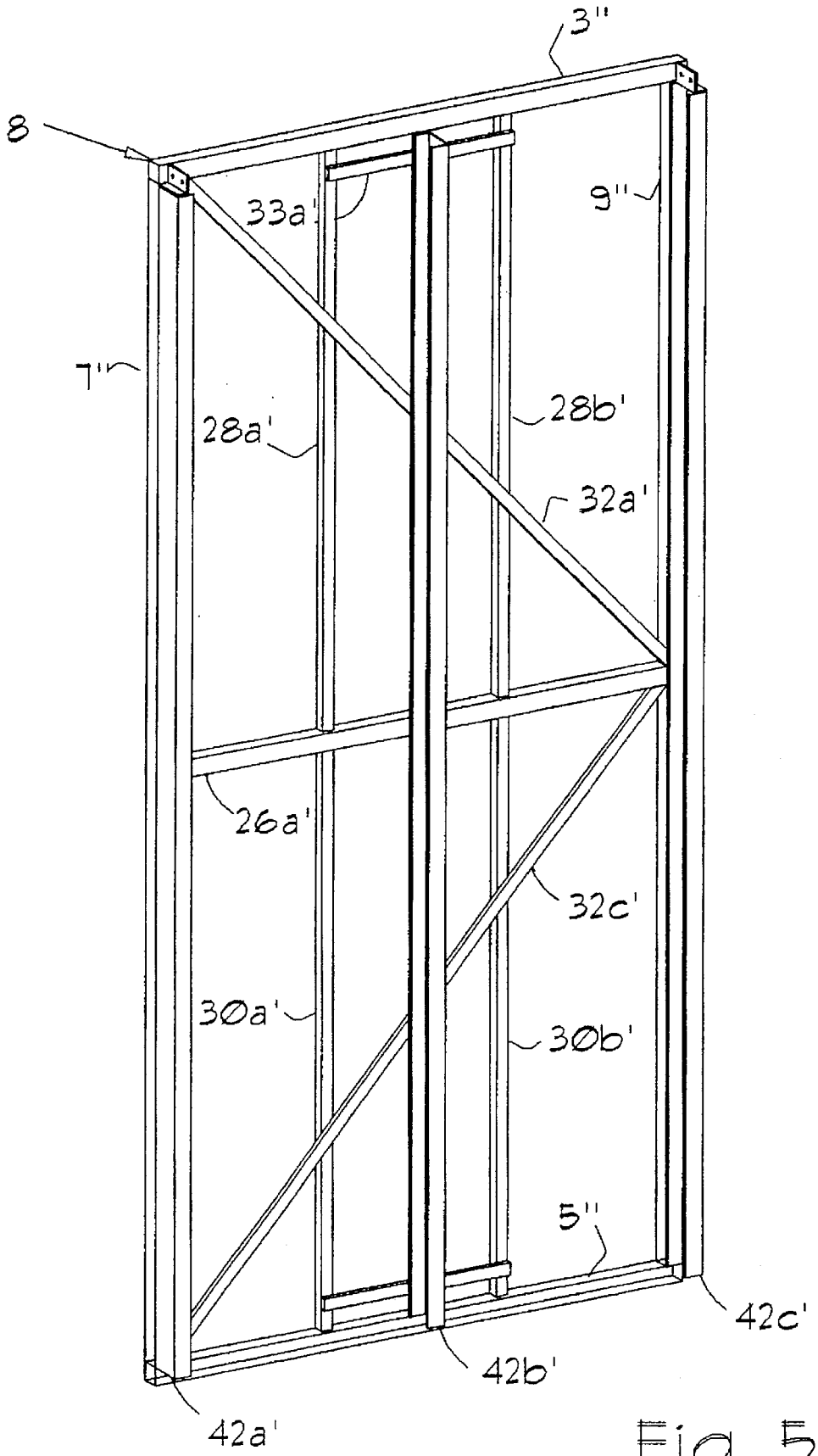
FIG. 5C is a perspective view of of the half panel subassembly depicted in FIG. 5.
Figure 6A:
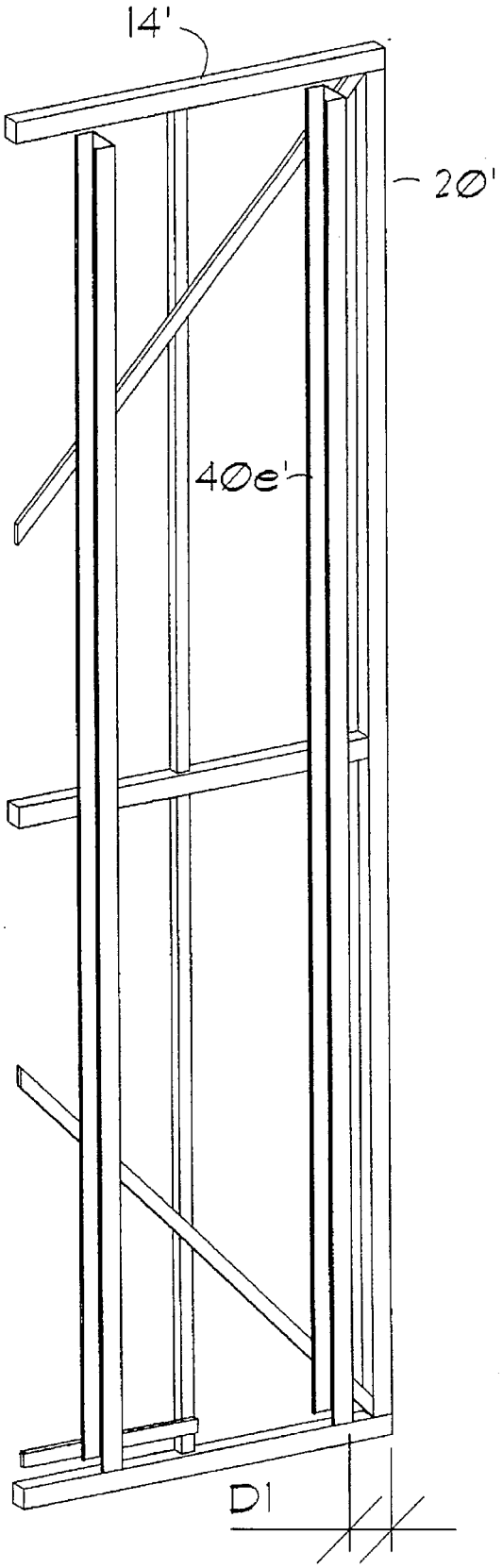
FIG. 6A is a partial perspective view of a side wall end top floor panel.
Figure 6B:
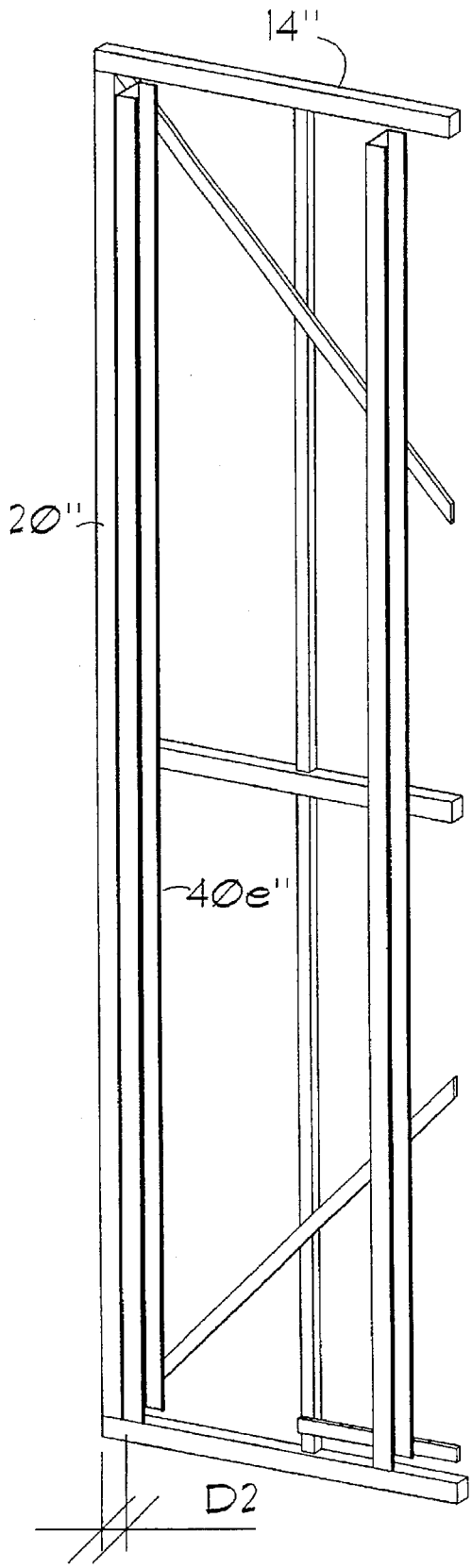
FIG 6B is a partial perspective view of an end wall top floor panel.

In many instances the desired length of a wall does not require a full length panel subassembly as described in FIGS. 1 and 2. As a compromise, an essentially half width panel subassembly is utilized. Examples of such are 6 of FIG. 4A and 8 of FIG. 5A which incorporate the same characteristics of subassemblies 2 and 4, presented in the isometric views of FIGS. 1 and 2, respectively, wherein the channel members have been omitted for clarity. FIGS. 4B and 5C show a perspective view of FIGS. 4A and 5A, respectively, wherein the channel members are added to illustrate their position and orientation. Hence, the buildings wall is essentially required to be a multiple number of full panel subassemblies plus a half panel subassembly in length. For convenience, the elements of this subassembly are identified by the same numerical designations used for the corresponding elements of FIGS. 1 and/or 2 and are primed. FIG. 5B shows a section of FIG. 5A taken along the line 5—5 in FIG. 5A, with the channel members added to illustrate their position and orientation. Since the half panel subassembly does not include a vertical dividing member corresponding to vertical dividing member 22 of FIG. 2, channel member 42*b'* is located midway between the vertical frame members, 7" and 9". The construction and materials used in this half panel subassembly are the same as that in FIGS. 1 and 2 and need not be further described. It should be noted that 6 of FIG. 4 depicts a first floor wall panel subassembly while 8 of FIG. 5A depicts the corresponding second floor panel subassembly aligned and overlying 6.

Where the subassemblies of FIGS. 1 and 2 are to be located at a corner of the building in which a vertical frame member of either subassembly is to be at a corner and abut a corresponding vertical frame member of another like subassembly oriented at a fight angle thereto, the channel members, which overlie such vertical frame members must be displaced in position as the channels would interfere with one another and cannot share the same space. Accordingly, the panel subassembly for those corner locations differ slightly in construction, by essentially displacing the end channel member in position as illustrated in the partial perspective views of FIGS. 6A and 6B to which reference is made. For convenience, elements in these figures are identified by the same numbers that were earlier used to identify the corresponding elements of the preceding figures and are primed and double primed. FIG. 6A shows a section of the end of and upper floor panel subassembly in which channel member 40*e'* is laterally displaced a predetermined distance, D1, from the vertical frame member 20'. This is for a corner at the side wall of the building structure, where the wall underlies the eaves of the roof. FIG. 6B shows a similar view of an upper story wall assembly for a corner at the end wall of the building structure, one which is parallel to the roof truss and orthogonal to the adjacent side wall corner panel. As shown, the channel member 40*e"* is laterally displaced a predetermined distance, D2, from vertical frame member 20". The channel member of the side wall subassembly is displaced a slightly larger distance from the end of the associated vertical frame member, meaning D1>D2. As an example, D1=five inches while D2=three and one half inches.

What is illustrated and described for the corner subassemblies for the upper floor wall subassembly in FIGS. 6A and 6B also hold true for the lower floor wall corner assembly, which are not separately illustrated. The channel member on those subassemblies are displaced from the respective vertical frame member as well. It is appreciated that the building system requires some variation in the various subassemblies. Even so, those subassemblies share many common aspects which allow for considerable savings in construction costs in comparison to on site construction using wood or steel stud framing and confines the slight complexities in the structure to the factory where they are more effectively controlled.

Figure 7:
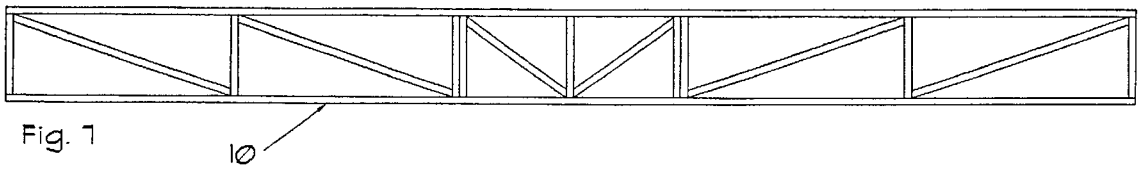
FIG. 7 is an elevational view of a floor truss attached orthogonal to the panel subassembly depicted in FIG. 1 drawn to the same scale.

FIG. 7 illustrates a typical floor truss, 10, in elevational view and to a reduced scale. The truss is a rectangular section of short height, corresponding in height to the riser section of the subassembly in FIG. 1. Preferably, the truss is formed of the same rectangular cross section tubular steel employed in the construction of the frame portion of the wall panel subassemblies. The truss contains outer frame members, intermediate vertical supports and diagonal struts, for bracing between the supports, as illustrated and are welded together to form a rigid skeleton. The aforementioned vertical supports are spaced in a manner so as to be consistent with the spacing of the vertical frame members within the subassemblies comprising the end wall of a building. As an example, the floor truss 10 is indicative of an end wall assembly of a building containing two full wall panel subassemblies and one half panel subassembly, wherein the full panels lie to each side of the half panel in the middle. The length of the truss may be equal to the distance between the side walls or, if greater width is desired, one or more truss may be joined together by bolting them in line to assemble a truss of greater length as taught in the prior Ressel Patent, all the while maintaining consistency between the vertical members of the end wall assembly and the vertical supports of the floor truss. It should be noted that the joining together or splicing inline of trusses is determined by the desire to maintain easily transportable component sizes in a building structure.

Figure 8:
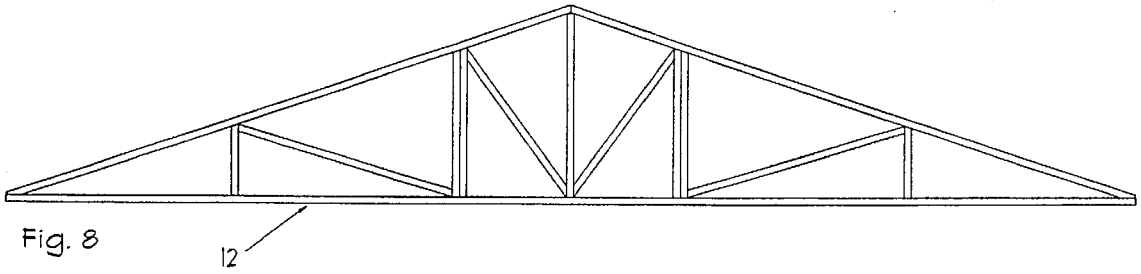
FIG. 8 is an elevational view of a gable end roof truss for a sloped roof.
Figure 9:
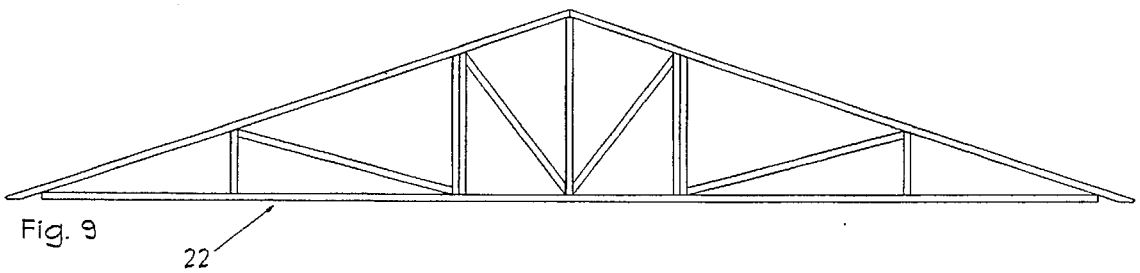
FIG. 9 is an elevational view of an intermediate roof truss for a sloped roof.

FIG. 8 illustrates a gable end roof truss, 12, in elevational view. FIG. 9 is a like view of an intermediate roof truss, 22 also in elevational view. The trusses are of a triangular shape and define the slope of a sloped roof. A roof truss may be fabricated in one piece as illustrated, or, two or three pieces that are bolted together at the building site prior to installation. The roof trusses are formed of the same tubular material as the frame portion of the wall panel subassemblies and are essentially the same as that construction described in the prior Ressel Patent, which may be referred to for additional details.

Figure 10:
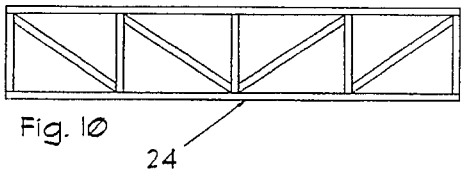
FIG. 10 is an elevational view of a short floor truss header for joining ends of floor trusses of a shorter length than that depicted in FIG. 7 drawn to scale equal to that floor truss.

A short floor truss, 24, is illustrated in elevational view in FIG. 10. This truss is bolted between separate floor trusses or between a floor truss and an end wall of a building and serves as and end or header to intermediate, short floor trusses, not illustrated, that are bolted at an end orthogonal to this truss. For example, this is used in those buildings in which one desires to form a floor opening for a stairwell. Thus, while some floor trusses may extend across the full width of the building, to form an opening in the floor a number of short floor trusses are used, with the ends thereof bolted to the short floor truss header 24. The length of the short floor truss is determined by the desired opening's width. That desired width is augmented in consideration of maintaining the consistency of the alignment of the vertical members within the end wall assembly and the vertical members of all floor trusses. The desired length of the opening is augmented in consideration of the spacing of the floor trusses. Where necessary, the trusses, and header(s) framing an opening for stairs are doubled, hence, two floor truss headers, 24 of FIG. 10. are bolted to one another as are two floor trusses, 10 of FIG. 7, offering increased bearing capacity of the floor around the opening.

Figure 11:
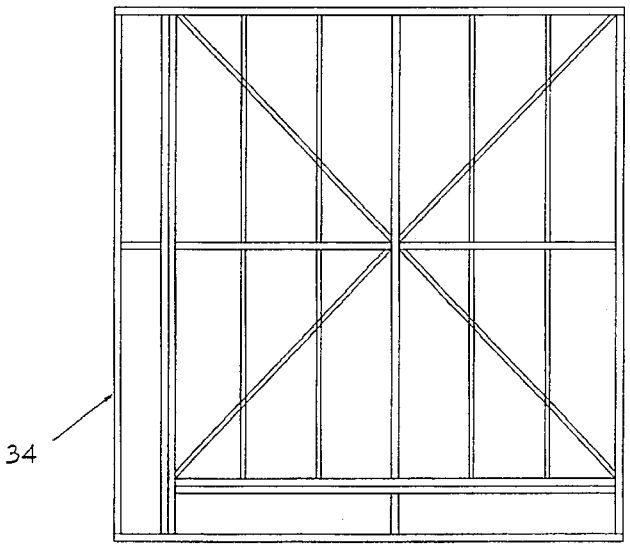
FIG. 11, 12 and 13 respectively illustrate in elevational view to an equal scale an end roof panel subassembly, an intermediate roof panel subassembly and an intermediate roof half panel subassembly— which corresponds to those side wall panel subassemblies depicted in FIGS. 4 and 5A, all of which are bolted atop the roof trusses of the building structure.

A roof panel, 34, the skeletal frame that is to be placed atop the roof trusses to support the covering roof materials applied in finishing the building, is illustrated in FIG. 11 in elevational view. The roof panel is seen to contain the same elements as those found to be successful in the wall panel subassemblies earlier described. It also contains two narrow rectangular sections that are to provide the overhang found in a building structure with a sloped roof. Assuming that a building structure is to be of a length that requires more than two roof panel in a side by side relationship, intermediate roof panels, those located between the front and back ends of the building, do not include the rectangular section that defines the overhang at the end wall, as shown by 36 of FIG. 12, but otherwise are of the same construction illustrated.

Figure 12:
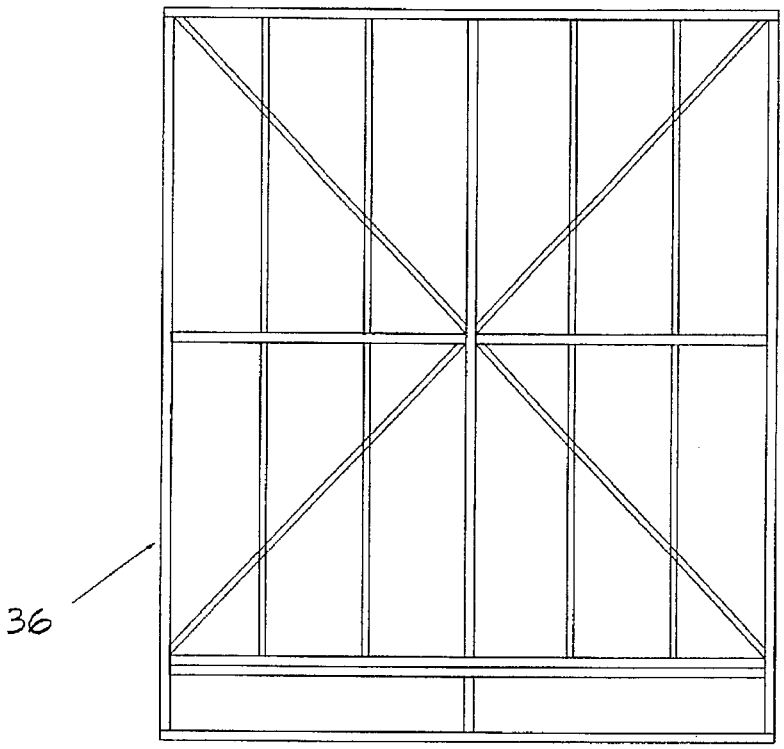
Figure 13:
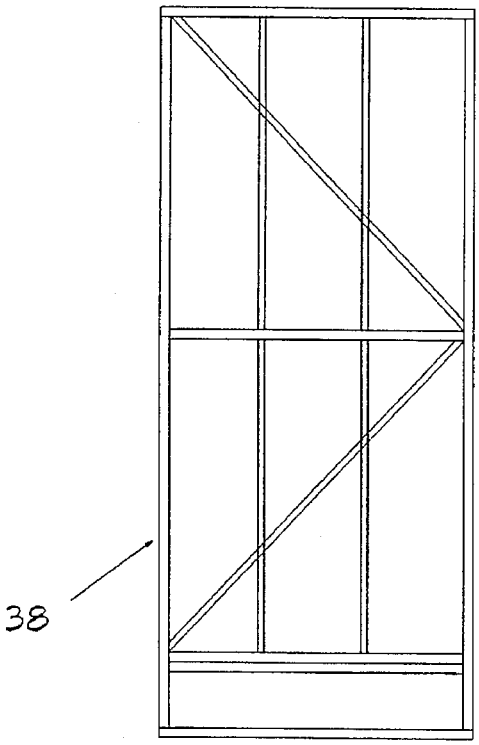

FIG. 11 presents a roof end panel subassembly 34, which is placed over the gable end roof truss at a corner of a building system. The subassembly includes short rectangular portions on its bottom, to provide for overhang of the building's side wall and on its left side, to provide for overhang of the building's end wall. Subassembly 34 contains the vertical supports and struts, all of which fit within the shallow rectanguloid volume defined by the outer frame members as earlier described in connection with the wall panel subassemblies of FIGS. 1 and 2. In the intermediate roof panel subassembly 36 of FIG. 12 only the bottom portion, that which provides for overhang of the building's side wall is included. It is appreciated that the width of the intermediate roof panel subassemblies is equal to the width of the wall panel subassemblies 2 and 4 in FIGS. 1 and 2, respectively. As was the situation with the wall half panel subassemblies earlier considered, a like half roof panel subassembly, 38, is illustrated in FIG. 13. The roof panel subassembly are formed of the same steel tubing as described in connection with wall panel subassemblies 2 and 4 in FIGS. 1 and 2, respectively, with the same cross section size for the corresponding elements. The roof panel subassemblies provide the support for any finish roofing material desired and its underlayment. Those materials are conventional and need not be described, although one may reference the Ressel Patent for additional details as needed.

Figure 14:
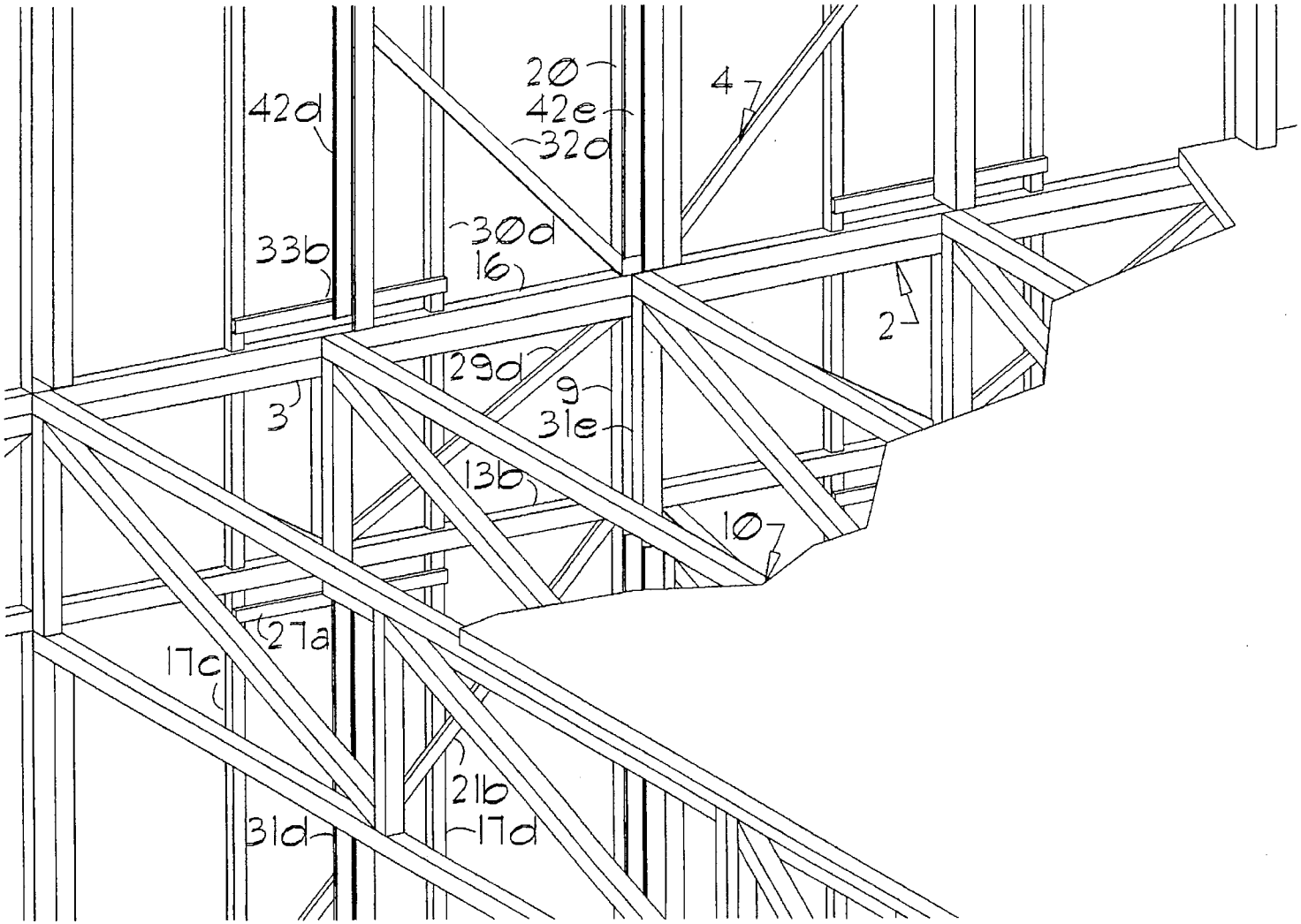
FIG. 14 is a partial perspective view illustrating the relationship between the subassemblies of FIGS. 1 and 2 and a floor truss illustrated in FIG. 7 as assembled in a multi-story build structure.

Reference is made to the partial perspective view of FIG. 14 viewing a portion of the building frame assembly from a vantage point just above the second story floor trusses. As assembled in a multi-story building, the first floor wall panel subassembly of FIG. 1, the second story wall panel subassembly of FIG. 2 and the floor truss of FIG. 4, as well as like adjacent subassemblies, not separately numbered for clarity, are assembled together as illustrated in the partial view. To ease in understanding, the elements appearing in this view are identified by the same numbers used in preceding views. While the elements are self evident, one may note the relationship between the bottom or foot portion of channel member 42*d*, shown in the upper left of the figure; it is above the top member of second floor truss member 10, suitably one and one half inches or so, thereby allowing sufficient clearance to insert sheets of flooring material, shown. The bottom frame member, 16, on the second floor wall panel subassembly is bolted to the underlying upper frame member, 3, of the first floor wall panel subassembly. The short vertical frame members of floor truss 10 and the adjacent floor trusses are bolted to the associated vertical frame members of conjunct panels, vertical dividing members, and the vertical risers of the first floor wall panel subassembly as shown in the figure.

Figure 15:
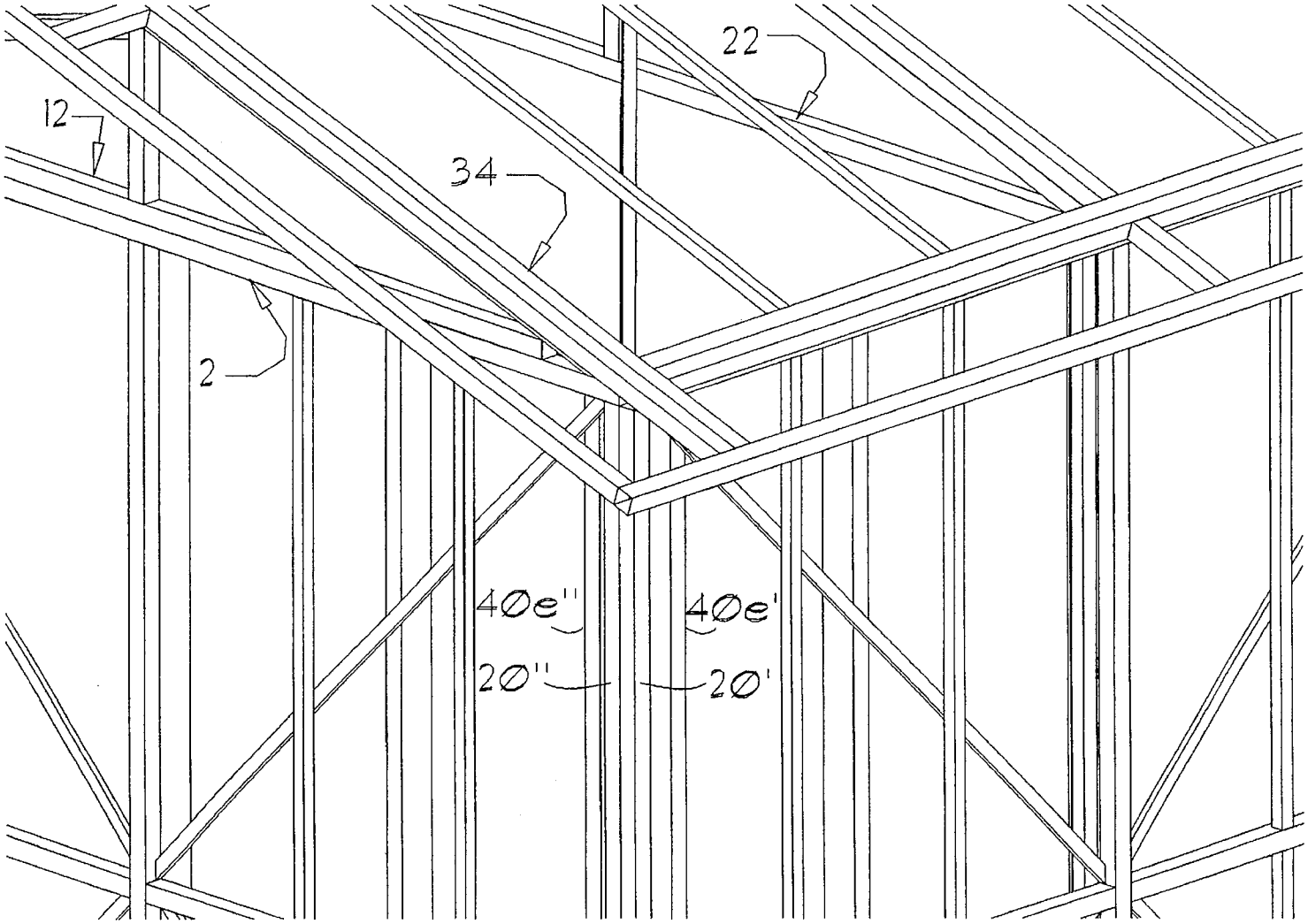
FIG. 15 is a partial perspective view illustrating the relationship between the subassembly of FIG. 2, the gable end roof truss of FIG. 9 and the end roof panel subassembly of FIG. 11 at a corner wherein the illustrations of FIGS. 6A and 6B are joined and viewed from the opposite side, all as assembled in a multi-story building or single story building.

As assembled in the multi-story building, two of the second story wall panel subassembly of FIG. 2, as described in association with FIGS. 6A and 6B, the roof trusses 12 and 22 of FIGS. 8 and 9, respectively, and the end roof panel subassembly, 34, of FIG. 11 are assembled together as illustrated in the partial perspective view of FIG. 15 to which references may be briefly made. The perspective of the view is from the outside of the building slightly above the second story wall assembly. This view aids in the understanding of the conjunction of the wall panel subassemblies at a corner of a building by showning the opposed view, albeit assembled, of those shown in FIGS. 6A and 6B. To ease in understanding the elements are identified by the same number used in the preceding views.

Figure 16:
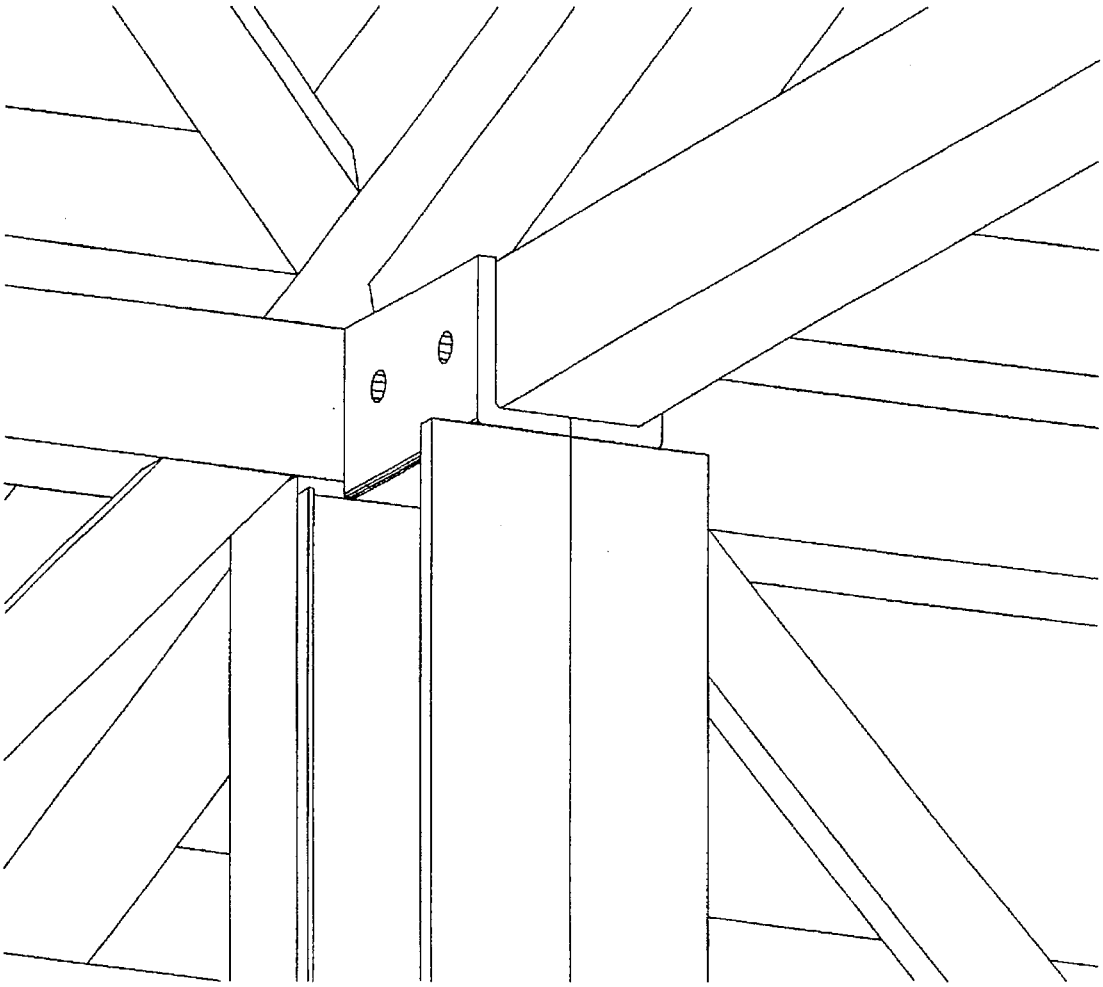
FIG. 16 is a partial perspective view illustrating the relationship between the panel subassembly of FIG. 2, the intermediate roof truss of FIG. 8, two of the roof panel subassembly of FIG. 12, and a first type saddle connector member.
Figure 17A:
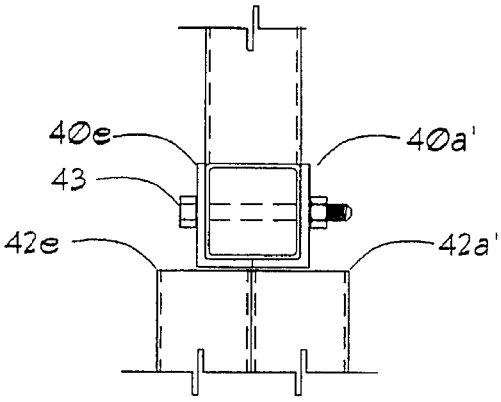
FIG. 17A and 17B show that saddle connector member in elevational and plan view, respectively.
Figure 17B:
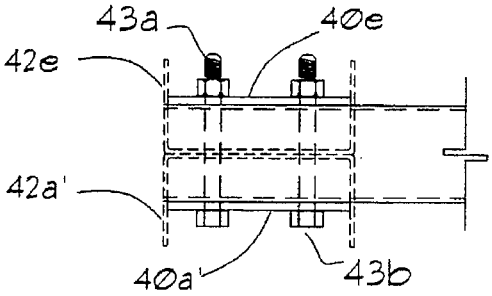
Figure 19B:
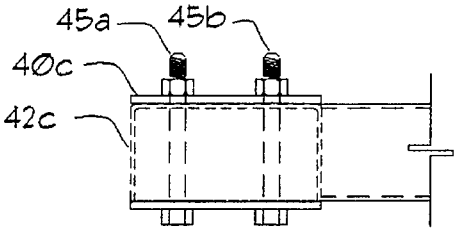

Reference is made to FIG. 16, which illustrates, in partial perspective view, looking up toward the roof frame, the conjunction of the upper floor wall panel subassemblies 4 and 4', roof truss 22, roof panel subassemblies 36 and 36', and a first type saddle connector 40*e* in an assembled relationship. Saddle member 40*e* comprises one half of the saddle connector prior to assembly. It is fabricated from a flat rectangular shaped piece of plate steel of a predetermined thickness, that is formed into one half of a U-shaped channel, similar to an 'L', and welded into place at the top of channel member 42*e* and upper end member 14, of wall panel subassembly 4. As better illustrated in the end view of FIG. 17A and the top view of FIG. 17B, saddle member 40*e*cooperates with a like saddle member 40*a'*, which is welded to the corresponding channel member 42*a'* and upper end member 14', of the adjacent wall panel subassembly 4'. When wall panel subassemblies 4 and, 4' are assembled, saddle members 40*e* and 40*a'* form the U-shaped saddle connector to receive the elongate horizontal member of the overlying truss 22. Each saddle members contains two bolt hole openings. Bolts 43*a* and 43*b*, in FIGS. 17A—bolt 43B not shown—and 17B, are inserted through saddle member 40*e*, the elongate horizontal member of roof truss 22 and saddle member 40*a'* and in a compressive manner rigidly attaches the roof truss 22 to the assembled wall panel subassemblies 4 and 4' via the saddle members. It is appreciated that such an assembly essentially integrates the affected subassemblies and contributes along with like assemblies to the integration of all the subassemblies contained in a building assembly.

Figure 19A:
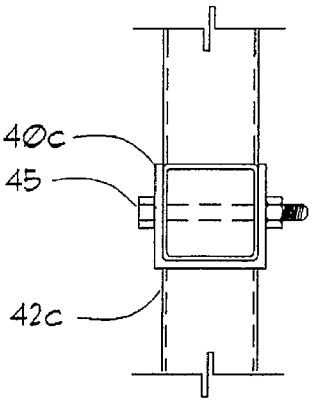
FIG. 19A and 19B show that saddle connector member in an elevational and plan view, respectively.
Figure 18:
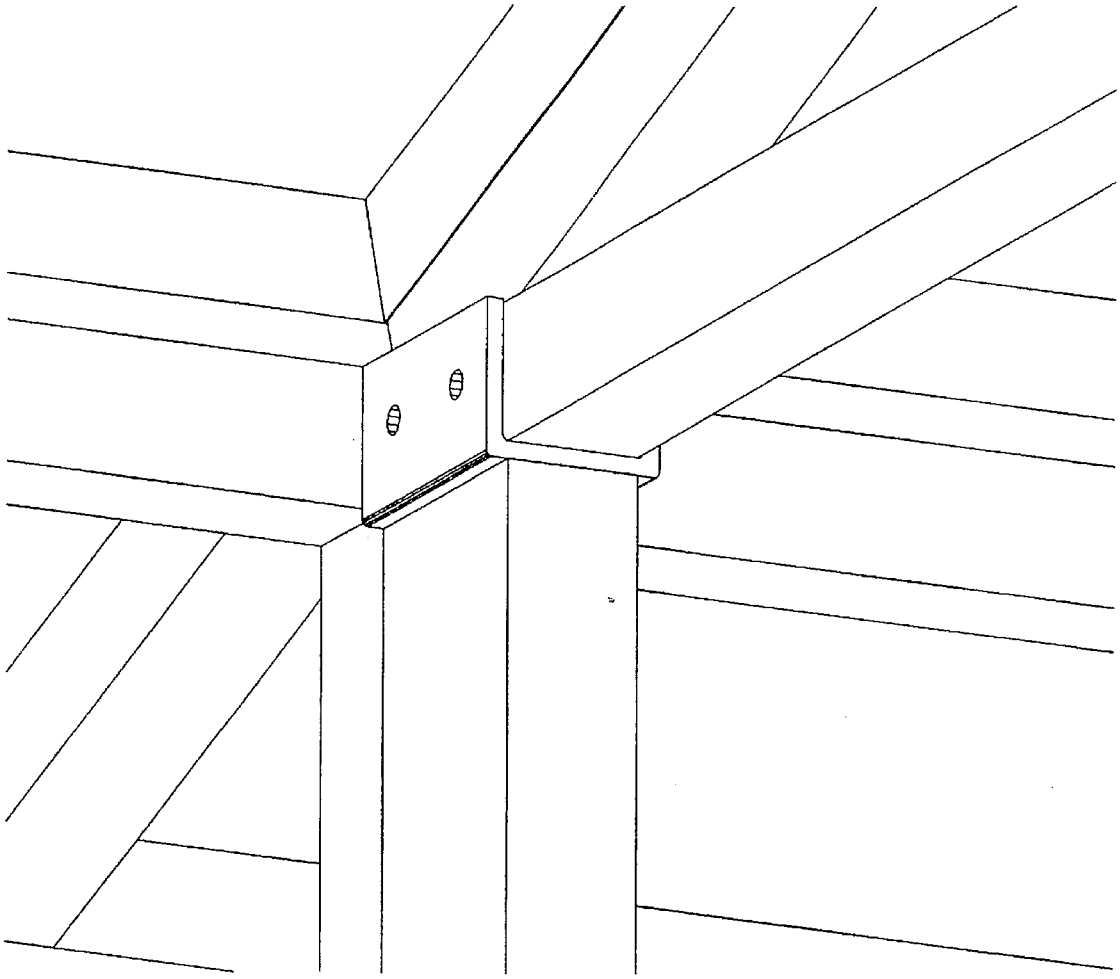
FIG. 18 is a partial perspective view illustrating the relationship of the subassembly of FIG. 2, the intermediate roof truss of FIG. 8, the roof panel subassembly of FIG. 12 and a second type saddle connector member.

FIG. 18 illustrates a like partial perspective view, looking up toward the roof frame, the conjunction of the upper floor wall panel subassembly 4, roof truss 22, roof panel subassembly 36', and a second type saddle connector, 40*c* in an assembled relationship. Saddle member 40*c* is essentially the assembled saddle members 40*e* and 40*a'* of FIG. 16 and is welded to the top of channel member 42*c*, which is attached to the vertical dividing member 22 of FIG. 2, and the upper end member 14. Saddle member 40*c* is a rectangular shaped piece of plate steel formed into a U-shaped channel wherein the two flanges each contain a pair of bolt holes. As illustrated in the end view of FIG. 19A and the top view of 19B, bolts 45*a* and 45*b* are inserted through saddle member 40*c* and the elongate horizontal member of roof truss 22 and in a compressive manner rigidly attaches the elongate horizontal member of roof truss 22' to the saddle connector 40*c* of wall panel subassembly 4.

In a multi-story building an opening in the floor will allow for the installation of a stairwell or the like. Additionally, a complete building customarily contains some windows and doors. Those known features deserve brief mention. It is appreciated that panel subassemblies for that purpose are modified to provide the appropriate rectangular opening to permit the installation of doors, windows and the like with appropriate bracing for same. One may refer to the Ressel Patent for examples of those types of modifications, which are incorporated herein for reference, and not to be repeated herein. The details of such obvious modifications are believed to be self evident to those skilled in the art and need not be further described.

Each panel assembly used in the assembly of the first floor is mounted to the preformed foundation and to the adjacent panel assembly by bolts. As illustrated to reduced scale in the partial section view of FIG. 20, to which reference is made, the preformed foundation at its perimeter contains a depressed portion, or step, that is recessed below the finished concrete floor so as to accommodate the lower member 5 of a wall panel subassembly and allow the channel member 42*c* to rest upon the finished concrete floor. Two bolts, such as bolt 47, are anchored in that depressed portion as illustrated. The bottom of the subassembly rests on the bottom of the depressed portion, while the bottom end of the posts of that subassembly are elevated and rest upon the finished concrete floor. As desired the subassemblies may be treated with an ant-corrosive wash, and painted with a chromate primer and a finish coat, if necessary, prior to assembly.

Figure 20:
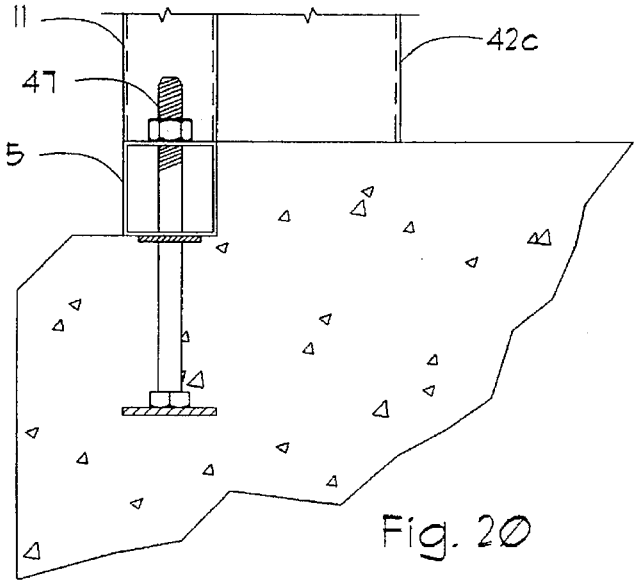
FIG. 20 is a partial section view illustrating the rigid connection of the panel subassembly to a preformed concrete foundation.

In assembling the multi-story building structure, the first floor wall panel subassemblies are placed in upstanding position on the foundation and are bolted to the foundation, as partially illustrated in FIG. 20. Adjacent wall panel subassemblies are also bolted to one another, with the appropriate side and end corner type wall panel subassemblies, as mentioned in connection with the discussion of FIGS. 6A and 6B, located at the buildings corners. Any of the subassemblies containing windows or doors are appropriately located in the series as required by the particular building design. The floor trusses, discussed in connection with FIG. 7, are each mounted between parallel side walls and orthogonal thereto, resting the ends of the floor truss upon the associated channel member, as in the panel subassembly of FIG. 1. The ends of the floor trusses are bolted to vertical frame members, 7 and 9, of connected panel subassemblies, the adjacent vertical riser 23, and vertical dividing member 11. At the junction of adjacent wall panel subassemblies, the floor truss' centerline is aligned with that junction. The floor truss is attached to each vertical frame member of the associated panel subassembly at that junction. The floor truss header, FIG. 10, is bolted between adjacent floor trusses or between a floor truss and an end wall as well as to those short floor trusses necessitating that header. The second story wall panel subassemblies such as in FIG. 2, and the corner subassemblies as in FIGS. 6A and 6B, any half panel subassemblies as in FIG. 5A and any subassemblies containing windows or doors for the second floor are appropriately located according to the building design and are bolted to the underlying first floor wall panel subassemblies, leaving a slight clearance between the foot of the channel members of the second floor wall panel subassemblies, as illustrated by channel member 42*d* and 42*e* of FIG. 14. Gable end roof trusses and intermediate roof trusses of FIGS. 8 and 9 are mounted between parallel side walls and orthogonal thereto, resting the ends of the trusses within in the appropriate saddle connector, rigidly connected thereto, atop the associated channel member as illustrated in FIGS. 16 and 18. The various roof panel subassemblies of FIGS. 11, 12 and 13 are mounted atop the roof trusses and are bolted thereto, to one another and to the side wall subassemblies to essentially complete the building structure, readying same for finishing. And an appropriate stairwell, not illustrated, extending between the second and first floors can then be installed.

To further complete the building an appropriate number of sheets of flooring material are attached to the tops of the floor trusses, appropriately with self drilling screws or the like, placing the edge thereof within the clearance under the foot of the channel members on the second floor wall panel subassemblies. The clearance may allow for a loose fit in wherein the channel's foot end does not contact the flooring material, or alternatively, may allow a tight fit so that the channel's foot end remains in contact with that material for providing additional support to the channel member. Similarly, exterior sheeting is attached to the outside face of the panel subassemblies, the separation between vertical support members, vertical frame members, and vertical dividing members being a customary industry spacing or otherwise being know to that person performing the labor. Thermal insulation blankets or other thermal insulation material may be added between the channels on the inside face of the subassemblies, with the blankets or the like oriented vertically. Dry wall panels are then fastened to the flange of the channel members with self drilling screw or the like, with the spacing between the channel members being a customary industry spacing or otherwise know to the person performing that labor, to finish the interior walls of both the upper and lower floors. Appropriate sheets of roofing material, standard plywood, wafer board, cement board and the like are place upon the roof panel subassemblies and fastened down with self drilling screws or the like. As is appreciated, the preformed subassemblies provide quick and easy assembly of a strong, integrated, and reliable structural frame.

It is believed that the foregoing description of the preferred embodiments of the invention are sufficient in detail to enable on skilled in the art to make and use the invention. However, it is expressly understood that the detail of the elements presented for the foregoing purposes in not intended to limit the scope of the invention, in as much as equivalents to those elements and other modifications thereof, all of which fall within the scope of the invention, will become apparent to those skilled in the art upon reading this specification. Thus the invention is to be broadly construed within the full scope of the appended claims.

We claim:

1. In a building system for erection of a building structure on a prepared foundation, the building system including a plurality of pre-fabricated wall panel subassemblies formed of tubular steel material, the building system comprising:

a frame of tubular steel material containing at least two vertical frame members, said frame defining a rectanguloid volume with an outer and inner rectangular face, each said face having a left edge and a right edge;

at least one horizontal dividing member formed of tubular steel material, said horizontal dividing member being rigidly connected between opposed vertical sides of said frame;

a plurality of vertical support members formed of tubular steel material, said vertical support members being located within said frame with a portion thereof located above said horizontal dividing member and a like remaining portion located below said horizontal dividing member, said vertical support members having a surface oriented flush with said outer face of said defined volume;

a plurality of strut members formed of tubular steel material, said strut members being rigidly connected diagonally between opposed vertical sides of said frame at intersections of said horizontal dividing members and said vertical frame members, and adjacent at least a portion of an inner surface of said plurality of vertical support members;

a plurality of vertically oriented U-shaped posts formed of steel material and being spaced apart horizontally, said posts being rigidly connected to an inner surface of said frame and protruding from said inner surface, away from said volume, each post having a foot portion for contacting a foundation external of said subassembly and having a top portion for supporting another building frame portion external of said subassembly, each of said posts having a saddle member extending from said top portion to a top edge of said frame, said saddle members comprising bolt openings.

2. The invention as defined in claim 1 wherein a first one of said posts is in vertical alignment with said vertical frame member at said left edge of said inner rectangular face, a second one of said posts is in vertical alignment with said vertical frame member at said right edge of said inner rectangular face, and the remaining ones of said posts being located therebetween said first and second ones of said posts.

3. In a building system for erection of a building structure on a prepared foundation, said building system including a plurality of pre-fabricated first type wall panel subassemblies, at least one of said first type wall panel subassemblies comprises:

a substantially rigid frame formed of steel tubing of predetermined tubing cross section shape and size, said frame having front and back faces, said frame including a right side vertical side member and a left side vertical side member, said vertical side members having an upper and lower end disposed in a parallel spaced apart relationship and a horizontally oriented upper end member and lower end member, said upper and lower end members having an upper side and a lower side and disposed in a parallel spaced apart relationship;

said vertical side members being rigidly connected between said lower side of said upper end member at said upper end of said vertical side members and said upper side of said lower end member at said lower end of said vertical side members;

a major vertical dividing member located within said frame, said major vertical dividing member having an upper and lower end, said major vertical dividing member being rigidly connected between said lower side of said upper end member at said upper end of said major vertical dividing member and extending vertically to said upper side of said lower end member at said lower end of said major vertical dividing member, said major vertical dividing member being oriented parallel to and equidistant from said right side vertical side member and said left side vertical side member, said major vertical dividing member being formed of steel tubing of the same cross section shape and size as said frame;

at least two pairs of horizontal dividing members located within said frame with each horizontal dividing member in a respective pair being in horizontal alignment and with a first one of said pairs being spaced parallel to and vertically above said second pair; said second pair being located equidistant from said first pair of horizontal dividing members and said lower end member; each of said pairs having a first and second horizontal dividing member; each of said horizontal dividing member of said pairs having an upper side and a lower side; subsequent said pairs of horizontal dividing members being spaced parallel to and a predetermined vertical distance above said first pair of horizontal dividing members;

said pairs of horizontal dividing members being formed of steel tubing of the same cross section shape and size as said frame;

said first horizontal dividing member of said first pair being rigidly connected between said left side vertical side member and said major vertical dividing member, said second horizontal dividing member of said first pair being rigidly connected between said right side vertical side member and said major vertical dividing member;

said first horizontal dividing member of said second pair being rigidly connected between said left side vertical side member and said major vertical dividing member, said second horizontal dividing member of said second pair being rigidly connected between said right side vertical side member and said major vertical dividing member;

a plurality of vertical support members, said vertical support members having an inner surface and an outer surface, said vertical support members being evenly divided into a first set of vertical support members and a second set of vertical support members, each said set of vertical support members being evenly divided into a first subset of vertical support members and a second subset of vertical support members;

said first subset of said first set of vertical support members being oriented vertically and spaced evenly between and parallel to said left side vertical side member and said major dividing member, said first subset of said first set being rigidly connected between said upper side of said lower end member and said lower side of said first horizontal dividing member of said second pair of horizontal dividing members, said second subset of said first set of vertical support members being oriented exactly as said first subset of said first set of vertical support members and rigidly connected between said upper side of said first horizontal dividing member of said second pair of horizontal dividing members, and said lower side of said first horizontal dividing member of said first pair of horizontal dividing members;

said first subset of said second set of vertical support members being oriented vertically and spaced evenly between and parallel to said right side vertical side member and said major dividing member, said first subset of said second set being rigidly connected between said upper side of said lower end member and said lower side of said second horizontal dividing member of said second pair of horizontal dividing members, said second subset of said second set of vertical support members being oriented exactly as said first subset of said second set of vertical support members and rigidly connected between said upper side of said second horizontal dividing member of said second pair of horizontal dividing members and said lower side of said second horizontal dividing member of said first pair of horizontal dividing members;

said vertical support members being formed of steel tubing of the same cross section shape as said frame members and ⅔ the size of said frame members and being oriented within said frame with said outer surface of said vertical frame members flush with said front face of said frame, said inner surface of said vertical frame members recessed ⅔ the distance between said front face and said back face from said front face of said frame;

a plurality of at least four strut members, each said strut member having a inner surface and outer surface, each said strut member extending from the juncture of said vertical side members and said upper end member and said lower end member respectively to the juncture of said second pair of horizontal dividing members and said major vertical dividing member;

a first of said strut members being rigidly connected diagonally from the juncture of said upper side of said lower end member and the surface on said left side vertical side member defined by the space between said front and back faces of said frame to the juncture of said lower side of said first horizontal dividing member of said second pair of said horizontal dividing members and the surface on said major vertical dividing member defined by the space between said front and back faces of said frame;

a second of said strut members being rigidly connected diagonally from the juncture of said lower side of said first horizontal dividing member of said first pair of horizontal dividing members and the surface on said left side vertical side member defined by the space between said front and back faces of said frame to the juncture of said upper side of said first horizontal dividing member of said second pair of said horizontal dividing members and the surface on said major vertical dividing member defined by the space between said front and back faces of said frame;

a third of said strut members being rigidly connected diagonally from the juncture of said upper side of said lower end member and the surface on said right side vertical side member defined by the space between said front and back faces of said frame to the juncture of said lower side of said second horizontal dividing member of said second pair of said horizontal dividing members and the surface on said major vertical dividing member defined by the space between said front and back faces of said frame;

a fourth of said strut members being rigidly connected diagonally from the juncture of said lower side of said second horizontal dividing member of said first pair of horizontal dividing members and the surface on said right side vertical side member defined by the space between said front and back faces of said frame to the juncture of said upper side of said second horizontal dividing member of said second pair of said horizontal dividing members and the surface on said major vertical dividing member defined by the space between said front and back faces of said frame;

subsequent strut members being oriented similar to said strut members wherein said junctures include said subsequent horizontal dividing members, said right and left side vertical side members and said major vertical dividing member;

said strut members being of formed of steel tubing rectangular in cross section and ⅔ the size of said frame members defining said inner and outer surfaces by ⅓ the size of said frame members defining the remaining sides of said strut members, said outer surface of said strut members being oriented within said frame flush with said back face of said frame, said inner surface of said strut members recessed ⅓ the distance between said back face and said front face from said back face of said frame, abutting and rigidly connected to said inner surface of said vertical support members;

a plurality of elongated U-shaped posts, said posts being located on said back face of said frame; said posts being vertically oriented in a parallel spaced apart relationship; each of said posts having a foot portion for contacting a foundation external of said subassembly and having a top portion for providing support to another building frame portion external of said subassembly;

a saddle connector member means rigidly connected to the upper end of each said post, said saddle connector members means containing a plurality of openings for receiving fasteners for connecting said fastener means to an external frame member.

4. The invention as defined in claim 3 wherein said plurality of posts are 5 (five) in number.

5. The invention as defined in claim 4 wherein a first one of said posts is rigidly connected along and is vertically aligned with said left side vertical side member, a second one of said posts is rigidly connected along and vertically aligned with said right side vertical side member, and a third one of said posts is rigidly connected along and vertically aligned with said major vertical dividing member.

6. The invention as defined in claim 5 wherein said subassembly further comprises:

a first horizontal bracket member comprising a length of tube of the same cross section, shape and size of said strut members and having an inner surface and an outer surface; said first horizontal bracket member being located within said frame a predetermined distance below said lower side of said upper end member and equidistant between said left side vertical side member and said major dividing member; said inner surface of said first horizontal bracket member being rigidly connected at each end to said inner surface of a respective said vertical support member; said outer surface of said first horizontal bracket member being oriented flush with said inner surface of said frame;

a second horizontal bracket member comprising a length of tube of the same cross section, shape and size of said strut members and having an inner surface and an outer surface; said second horizontal bracket member being located within said frame a predetermined distance below said lower side of said upper end member and equidistant between said right side vertical side member and said major dividing member; said inner surface of said second horizontal bracket member being rigidly connected at each end to said inner surface of a respective said vertical support member; said outer surface of said second horizontal bracket member being oriented flush with said inner surface of said frame;

and wherein said fourth one of said posts is rigidly connected between said first horizontal bracket member and said upper side of said lower end member;

and wherein said fifth one of said posts is rigidly connected between said second horizontal bracket member and said upper side of said lower end member.

7. The invention as defined in claim 3 wherein each of said posts is oriented with said first type panel subassembly thereof orthogonal to said frame member.

8. The invention as defined in claim 3 wherein said plurality of posts comprise five in number and wherein a first one of said posts is located in alignment with said left side vertical side member, a second of said posts is located in alignment with said right side vertical side member, a third one of said posts is located in alignment with said major vertical dividing member, a fourth of said posts is located intermediate of said major vertical dividing member and said left side vertical side member and a fifth of said posts is located intermediate of said major vertical dividing member and said right side vertical side member.

9. The invention as defined in claim 3 wherein said plurality of posts comprise five in number and wherein a first one of said posts is located in alignment with said left side vertical side member, a second one of said posts is located adjacent to and extending parallel with said right side vertical side member, a third one of said posts is located in alignment with said major vertical dividing member, a fourth of said posts is located intermediate of said major vertical dividing member and said left side vertical side member and a fifth of said posts is located intermediate of said major vertical dividing member and said right side vertical side member.

10. The invention as defined in claim 3 further comprising:

a pair of short vertical dividing members; each of said pair having an upper end and a lower end;

a first short vertical dividing member of said pair of short vertical dividing members being located equidistant from said left side vertical side member and said major vertical dividing member and being rigidly connected between said lower side of said upper end member and said upper side of said first horizontal dividing member of said first pair of horizontal dividing members;

a second short vertical dividing member of said pair of short vertical dividing members being located equidistant from said right side vertical side member and said major vertical dividing member and being rigidly connected between said lower side of said upper end member and said upper side of said second horizontal dividing member of said first pair of horizontal dividing members;

a plurality of short vertical support members, said short vertical support members having an inner surface and an outer surface, said short vertical support members being evenly divided into a first set of short vertical support members and a second set of short vertical support members; said short vertical support members being located in vertical alignment with said vertical support members;

said first set of short vertical support members being oriented vertically and spaced evenly between and parallel to said left side vertical side member and said major dividing member, said first set being rigidly connected between said lower side of said upper end member and said upper side of said first horizontal dividing member of said first pair of horizontal dividing members;

said second set of short vertical support members being oriented vertically and spaced evenly between and parallel to said right side vertical side member and said major dividing member, said second set being rigidly connected between said lower side of said upper end member and said upper side of said second horizontal dividing member of said first pair of horizontal dividing members;

said short vertical support members being formed of steel tubing of the same cross section shape as said frame members and ⅔ the size of said frame members and being oriented within said frame with said outer surface of said vertical frame members flush with said front face of said frame, said inner surface of said vertical frame members recessed ⅔ the distance between said front face and said back face from said front face of said frame;

a plurality of four short strut members, each said short strut member having a inner surface and outer surface, each said short strut member extending from the junctures of said vertical side members and said upper end member, and said major vertical dividing member and said upper end member to the junctures of said short vertical support members and said first pair of horizontal dividing members;

a first of said short strut members being rigidly connected from the juncture of said left side vertical side member and said upper end member to the juncture of said lower end of said first short vertical dividing member of said pair of short vertical dividing members and said first horizontal dividing member of said first pair of horizontal dividing members;

a second of said short strut members being rigidly connected from the juncture of said major vertical dividing member and said upper end member to the juncture of said lower end of said first short vertical dividing member of said pair of short vertical dividing members and said first horizontal dividing member of said first pair of horizontal dividing members;

a third of said short strut members being rigidly connected from the juncture of said major vertical dividing member and said upper end member to the juncture of said lower end of said second short vertical dividing member of said pair of short vertical dividing members and said second horizontal dividing member of said first pair of horizontal dividing members;

a fourth of said short strut members being rigidly connected from the juncture of said right side vertical side member and said upper end member to the juncture of said lower end of said second short vertical dividing member of said pair of short vertical dividing members and said second horizontal dividing member of said first pair of horizontal dividing members.

11. The invention as defined in claim 5 wherein said posts extend vertically between said upper side of said lower end member to the lower side of said first pair of horizontal dividing members.

12. The invention as defined in claim 3 wherein said panel subassembly further comprises:

a plurality of saddle members, each said saddle member being rigidly connected to said top portion of a respective post of said first type panel subassembly and said first pair of said horizontal dividing members on said back face of said first type panel subassembly for connecting to a member external of said frame, said saddle members having an upper end aligned with the upper side of said first pair of said horizontal dividing members of said first type panel subassembly; and bolt means connecting said saddle members to a member external of said frame.

13. The invention as defined in claim 2 wherein said building system includes at least one second type panel subassembly with said second type panel subassembly being located overlying and in alignment with said first type panel subassembly; said second type panel subassembly comprising:

a substantially rigid frame formed of steel tubing of a predetermined tubing cross section shape and size, said frame having front and back faces, said frame including a right side vertical side member and a left side vertical side member, said vertical side members having an inner side and an outer side, said vertical side members having an upper and lower end and being disposed in a parallel spaced apart relationship, and horizontally oriented upper end and lower end members, said upper and lower end members having an upper side and a lower side and disposed in a parallel spaced apart relationship;

said vertical side members being rigidly connected between said lower side of said upper end member at said upper end of said vertical side members and said upper side of said lower end member at said lower end of said vertical side members;

said frame also including a major vertical dividing member located within said frame, said major vertical dividing member having an upper and lower end, said major vertical dividing member being rigidly connected between said lower side of said upper end member at said upper end of said major vertical dividing member and extending vertically to said upper side of said lower end member at said lower end of said major vertical dividing member, said major vertical dividing member being oriented parallel to and equidistant from said right side vertical side member and said left side vertical side member, said major vertical dividing member being formed of steel tubing of the same cross section shape and size as said frame;

a pair of horizontal dividing members located within said frame oriented parallel to and equidistant from said upper and lower end members, said pair having a first and second horizontal dividing member, each horizontal dividing member of said pair having an upper side and a lower side, said first horizontal dividing member of said pair being rigidly connected between said left side vertical side member and said major vertical dividing member, said second horizontal dividing member of said pair being rigidly connected between said right side vertical side member and said major vertical dividing member, said pair of horizontal dividing members being formed of steel tubing of the same cross section shape and size as said frame;

a plurality of vertical support members, said vertical support members having an inner surface and an outer surface, said vertical support members being evenly divided into a first set of vertical support members and a second set of vertical support members, each said set of vertical support members being evenly divided into a first subset of vertical support members and a second subset of vertical support members;

said first subset of said first set of vertical support members being oriented vertically and spaced evenly between and parallel to said left side vertical side member and said major dividing member, said first subset of said first set being rigidly connected between said upper side of said lower end member and said lower side of said first horizontal dividing member of said pair of horizontal dividing members, said second subset of said first set of vertical support members being oriented exactly as said first subset of said first set of vertical support members and rigidly connected between said upper side of said first horizontal dividing member of said pair of horizontal dividing members and said lower side of said upper end member;

said first subset of said second set of vertical support members being oriented vertically and spaced evenly between and parallel to said right side vertical side member and said major dividing member, said first subset of said second set being rigidly connected between said upper side of said lower end member and said lower side of said second horizontal dividing member of said pair of horizontal dividing members, said second subset of said second set of vertical support members being oriented exactly as said first subset of said second set of vertical support members and rigidly connected between said upper side of said second horizontal dividing member of said pair of horizontal dividing members and said lower side of said upper end member;

said vertical support members being formed of steel tubing of the same cross section shape as said frame members and ⅔ the size of said frame members and being oriented within said frame with said outer surface of said vertical frame members flush with said front face of said frame, said inner surface of said vertical frame members being recessed ⅔ the distance between said front face and said back face from said front face of said frame;

a plurality of four strut members, each said strut member having a inner surface and outer surface, each said strut member extending from the junctures of said vertical side members and said upper and lower end members to the junctures of said pair of horizontal dividing members and said major vertical dividing member;

a first of said strut members being rigidly connected diagonally from the juncture of said upper side of said lower end member and said inner side of said left side vertical side member of said frame to the juncture of said lower side of said first horizontal dividing member of said pair of said horizontal dividing members and the surface on said major vertical dividing member defined by the space between said front and back faces of said frame;

a second of said strut members being rigidly connected diagonally from the juncture of said lower side of said upper end member and said inner side of said left side vertical side member of said frame to the juncture of said upper side of said first horizontal dividing member of said pair of said horizontal dividing members and the surface on said major vertical dividing member defined by the space between said front and back faces of said frame;

a third of said strut members being rigidly connected diagonally from the juncture of said upper side of said lower end member and said inner side of said right side vertical side member of said frame to the juncture of said lower side of said second horizontal dividing member of said pair of said horizontal dividing members and the surface on said major vertical dividing member defined by the space between said front and back faces of said frame;

a fourth of said strut members being rigidly connected diagonally from the juncture of said lower side of said upper end member and said inner side of said right side vertical side member of said frame to the juncture of said upper side of said second horizontal dividing member of said pair of said horizontal dividing members and the surface on said major vertical dividing member defined by the space between said front and back faces of said frame;

said strut members being of formed of steel tubing rectangular in cross section and ⅔ the size of said frame members defining said inner and outer surfaces and ⅓ the size of said frame members defining the distance between said inner and outer surfaces of said strut members, said outer surface of said strut members being oriented within said frame flush with said back face of said frame, said inner surface of said strut members recessed ⅓ the distance between said back face and said front face from said back face of said frame, and abutting and rigidly connected to said inner surface of said vertical support members;

a plurality of elongated posts, said post being located on said back face of said frame; said posts being vertically oriented in a parallel spaced apart relationship; each said posts having a foot portion for contacting a foundation external of said subassembly or another building frame member and a top portion providing support to a roof truss external of said subassembly;

and wherein said posts of said second type panel subassembly are vertically aligned with respective posts of said first type panel subassembly.

14. The invention as defined in claim 13 wherein said building system further comprises:

A floor truss, said floor truss being formed of steel tubing defining a shallow rectangular frame; said floor truss having an upper and lower surface, said floor truss being oriented orthogonal to said first type panel subassembly with said lower surface thereof contacting said top portion of a post in said first type panel subassembly.

15. The invention as defined in claim 14 wherein said upper surface of said floor truss is spaced a distance below the foot portion of a post on second type panel subassembly;

said distance being defined by the distance between said upper side of said lower end member and said lower side of said lower end member of said second type panel subassembly; said distance to accommodate the application of flooring material to said floor trusses.

16. The invention as defined in claim 15, further comprising:

at least one roof truss, said roof truss being formed of steel tubing of same cross section shape and size as said frame members, said roof truss defining a triangular shape and including an elongate horizontal member formed of steel tubing of same cross section shape and size as said frame members as a base thereto; said elongate horizontal member having both and upper side and a lower side; and a plurality of saddle connector members, each said saddle connector member being rigidly connected to said top portion of a respective post of said second type panel subassembly and said upper member on said back face of said second type panel subassembly for connecting to said elongate horizontal member of said roof truss, said saddle connector members having an upper end aligned with the upper side of said upper frame member of said second type panel subassembly and said upper side of said elongate horizontal member; and bolt means connecting said saddle connector member to said elongate horizontal member of said roof truss;

a middle roof panel comprising a substantially rigid frame formed of steel tubing of the same cross section shape and size as said frame members of said first type panel subassembly and said second type panel subassembly, said frame having a front and a back face, said frame including: a right side vertical side member and a left side vertical side member, said vertical side members having an upper and a lower end, said vertical side members having an inner side and an outer side and being disposed in a parallel spaced apart relationship; a horizontally oriented upper and lower end members, said upper and lower end members having an upper side and a lower side and disposed in a parallel spaced apart relationship; and a double horizontal member, said double horizontal member having an upper side and a lower side, disposed parallel to and spaced vertically a predetermined distance above said lower end member, said double horizontal member comprising two steel tubes of the same cross section and shape of said frame;

said vertical side members being rigidly connected between said lower side of said upper end member at said upper end of said vertical side members and said upper side of said lower end member at said lower end of said vertical side members;

said double horizontal member being rigidly connected within said frame between said inner side of said left side vertical side member and said inner side of said right side vertical side member, said double horizontal member being formed of two steel tubes being rigidly connected to one another in a parallel vertical abutting relationship, and of the same cross section shape and size as said frame members;

said predetermined distance being the distance between the lower side of said lower end member and the center line of said double horizontal member, said distance defines the overhang or under eave soffit of said building;

a major vertical dividing member located within said frame, said major vertical dividing member having an upper and lower end, said major vertical dividing member being rigidly connected between said lower side of said upper end member at said upper end of said major vertical dividing member and extending vertically to said upper side of said double horizontal member at said lower end of said major vertical dividing member, said major vertical dividing member being oriented parallel to and equidistant from said right side vertical side member and said left side vertical side member, said major vertical dividing member being formed of steel tubing of the same cross section shape and size as said frame;

a pair of horizontal dividing members located within said frame oriented parallel to and equidistant from said upper and lower end members, said pair having a first and second horizontal dividing member, each horizontal dividing member of said pair having an upper side and a lower side, said first horizontal dividing member of said pair being rigidly connected between said left side vertical member and said major vertical dividing member, said second horizontal dividing member of said pair being rigidly connected between said right side vertical side member and said major vertical dividing member, said pair of horizontal dividing members being formed of steel tubing of the same cross section shape and size as said frame;

a plurality of vertical support members, said vertical support members having an inner surface and an outer surface, said vertical support members being evenly divided into a first set of vertical support members and a second set of vertical support members, each said set of vertical support members being evenly divided into a first subset of vertical support members and a second subset of vertical support members;

said first subset of said first set of vertical support members being oriented vertically and spaced evenly between and parallel to said left side vertical side member and said major dividing member, and being rigidly connected between said upper side of said double horizontal member and said lower side of said first horizontal dividing member of said pair of horizontal dividing members, said second subset of said first set of vertical support members being oriented exactly as said first subset of said first set of vertical support members and rigidly connected between said upper side of said first horizontal dividing member of said pair of horizontal dividing members and said lower side of said upper end member;

said first subset of said second set of vertical support members being oriented vertically and spaced evenly between and parallel to said right side vertical side member and said major dividing member, and being rigidly connected between said upper side of said double horizontal member and said lower side of said second horizontal dividing member of said pair of horizontal dividing members, said second subset of said second set of vertical support members being oriented exactly as said first subset of said second set of vertical support members and rigidly connected between said upper side of said second horizontal dividing member of said pair of horizontal dividing members and said lower side of said upper end member;

said vertical support members being formed of steel tubing of the same cross section shape as said frame members and ⅔ the size of said frame members and being oriented within said frame with said outer surface of said vertical frame members flush with said front face of said frame, said inner surface of said vertical frame members being recessed ⅔ the distance between said front face and said back face from said front face of said frame;

a plurality of four strut members, each said strut member having a inner surface and outer surface, each said strut member extending from the junctures of said vertical side members and said upper end member and said double horizontal member to the junctures of said pair of horizontal dividing members and said major vertical dividing member;

a first of said strut members being rigidly connected diagonally from the juncture of said upper side of said double horizontal member and the surface on said left side vertical side member defined by the space between said front and back faces of said frame to the juncture of said lower side of said first horizontal dividing member of said pair of said horizontal dividing members and the surface on said major vertical dividing member defined by the space between said front and back faces of said frame;

a second of said strut members being rigidly connected diagonally from the juncture of said lower side of said upper end member and the surface on said left side vertical side member defined by the space between said front and back faces of said frame to the juncture of said upper side of said first horizontal dividing member of said pair of said horizontal dividing members and the surface on said major vertical dividing member defined by the space between said front and back faces of said frame;

a third of said strut members being rigidly connected diagonally from the juncture of said upper side of said double horizontal member and the surface on said right side vertical side member defined by the space between said front and back faces of said frame to the juncture of said lower side of said second horizontal dividing member of said pair of said horizontal dividing members and the surface on said major vertical dividing member defined by the space between said front and back faces of said frame;

a fourth of said strut members being rigidly connected diagonally from the juncture of said lower side of said upper end member and the surface on said right side vertical side member defined by the space between said front and back faces of said frame to the juncture of said upper side of said second horizontal dividing member of said pair of said horizontal dividing members and the surface on said major vertical dividing member defined by the space between said front and back faces of said frame;

said strut members being of formed of steel tubing rectangular in cross section and ⅔ the size of said frame members defining said inner and outer surfaces and ⅓ the size of said frame members defining the distance between said inner and outer surfaces of said strut members, said outer surface of said strut members being oriented within said frame flush with said back face of said frame, said inner surface of said strut members recessed ⅓ the distance between said back face and said front face from said back face of said frame, and abutting and rigidly connected to said inner surface of said vertical support members;

a left corner roof panel comprising a substantially rigid frame formed of steel tubing of predetermined tubing cross section shape and size, said left corner roof panel being similar to said middle roof panel and including a double vertical member, said double vertical member having an inner side and outer side, said double vertical member being disposed parallel to and spaced horizontally a predetermined distance from said left side vertical side member, said double vertical member comprising two steel tubes being rigidly connected to one another and between said lower side of said upper end member and said upper side of said lower end member and being oriented in a parallel, horizontally abutting relationship and of the same cross section shape and size of said frame;

said predetermined distance being defined by the distance between said outer side of said left side vertical side member and the center line of said double vertical member, said predetermined distance defines the overhang or under rake soffit of said building;

a right corner roof panel comprising a substantially rigid frame formed of steel tubing of a predetermined tubing cross section shape and size, said right corner panel being a mirror image of said left corner roof panel.

17. In a building system for erection of a building structure on a prepared foundation, said building system may include at least two pre-fabricated half wall panel subassemblies, at least one of said half wall panel subassemblies comprising:

a substantially rigid frame formed of steel tubing of predetermined tubing cross section shape and size, said frame having front and back faces, said frame including right side vertical side member and a left side vertical side member, said vertical side members having an upper and lower end disposed in a parallel spaced apart relationship, said vertical side members having an inner and an outer side, a horizontally oriented upper end member and lower end member, said upper and lower members having an upper side and a lower side and disposed in a parallel spaced apart relationship and a horizontal dividing member;

said vertical side members being rigidly connected between said lower side of said upper end member at said upper end of said vertical side members and said upper side of said lower end member at said lower end of said vertical side members;

said horizontal dividing member being located within said frame, oriented parallel to and equidistant from said upper and lower end members, said horizontal dividing member having an upper side and a lower side, said horizontal dividing member being rigidly connected between said inner sides of said left side vertical member and said right side vertical side member, said horizontal dividing members being formed of steel tubing of the same cross section shape and size as said frame;

a plurality of vertical support members, said vertical support members having an inner surface and an outer surface, said vertical support members being evenly divided into a first set of vertical support members and a second set of vertical support members;

said first set of vertical support members being oriented vertically and spaced evenly between and parallel to said left side vertical side member and said right side vertical side member, said first set being rigidly connected between said upper side of said lower end member and said lower side of said of horizontal dividing member;

said second set of vertical support members being oriented vertically and spaced evenly between and parallel to said left side vertical side member and said right side vertical side member, said first subset of said second set being rigidly connected between said upper side of said lower end member and said lower side of said horizontal dividing member;

said vertical support members being formed of steel tubing of the same cross section shape as said frame members and ⅔ the size of said frame members and being oriented within said frame with said outer surface of said vertical support members flush with said front face of said frame, said inner surface of said vertical support members recessed ⅔ the distance between said front face and said back face from said front face of said frame;

a plurality of two strut members, each said strut member having an inner surface and an outer surface, each said strut member extending from the juncture of said left side vertical side member and said upper end member and said lower end member respectively to the juncture of said horizontal dividing member and said vertical side member;

a first of said strut members being rigidly connected diagonally from the juncture of said upper side of said lower end member and said inner side of said left side vertical side member of said frame to the juncture of said lower side of said horizontal dividing member and the surface on said right side vertical side member;

a second of said strut members being rigidly connected diagonally from the juncture of said lower side of said upper end member and said inner side of said left side vertical side member of said frame to the juncture of said upper side of said horizontal dividing members and said inner side of said right side vertical side member;

said strut members being of formed of steel tubing rectangular in cross section and ⅔ the size of said frame members defining said inner and outer surfaces and ⅓ the size of said frame members defining the distance between said inner and outer surfaces of said strut members, said outer surface of said strut members being oriented within said frame flush with said back face of said frame, said inner surface of said strut members recessed ⅓ the distance between said back face and said front face from said back face of said frame, abutting and rigidly connected to said inner surface of said vertical support members;

a plurality of elongated U-shaped posts, said posts being located on said back face of said frame; said posts being vertically oriented in a parallel spaced apart relationship; each of said posts having a foot portion for contacting a foundation external of said subassembly and having a top portion for providing support to a roof truss external of said subassembly;

a saddle connector member means rigidly connected to the upper end of each said post, said saddle connector members means containing a plurality of openings for receiving fasteners for connecting said fastener means to an external frame member.

18. The invention as defined in claim 17 further comprising:

a saddle connector member rigidly connected to the upper end of each said post, said saddle connector member means containing a plurality of openings for receiving fasteners for connecting said fastener means to an external frame member.

19. The invention as defined in claim 17 wherein said posts include a bottom end, and wherein said bottom end of said posts are recessed from the lower side of said lower end member to define a step therebetween.

20. The invention as defined in claim 16 wherein said building may include at least one scissor roof truss; said scissor roof truss being similar to said roof truss wherein the mid point of said elongate horizontal member is elevated a predetermined distance vertically so as to facilitate a vaulted type ceiling.

21. The invention as defined in claim 17 wherein each said fastening means comprises a weld.

* * * * *